US005336592A

United States Patent [19]

Chino et al.

[11] Patent Number: 5,336,592

[45] Date of Patent: Aug. 9, 1994

[54] SILVER HALIDE PHOTOGRAPHIC LIGHT-SENSITIVE MATERIAL

[75] Inventors: Shigeo Chino; Takashi Kadowaki; Toyoki Nishijima, all of Odawara, Japan

[73] Assignee: Konica Corporation, Tokyo, Japan

[21] Appl. No.: 970,939

[22] Filed: Nov. 3, 1992

[30] Foreign Application Priority Data

Nov. 12, 1991 [JP] Japan ..... 3-323838

[51] Int. Cl.[5] ..... G03C 1/08; G03C 7/26; G03C 7/32

[52] U.S. Cl. ..... 430/557; 430/603; 430/621; 430/622; 430/623; 430/626; 430/642

[58] Field of Search ..... 430/557, 603, 621, 622, 430/623, 626, 642

[56] References Cited

U.S. PATENT DOCUMENTS

| | | | |
|---|---|---|---|
| 4,824,774 | 4/1989 | Inoue et al. | 430/566 |
| 4,962,016 | 10/1990 | Chino et al. | 430/622 |
| 4,992,360 | 2/1991 | Tsuruta et al. | 430/557 |
| 4,994,361 | 2/1991 | Tomotake et al. | 430/557 |
| 5,023,169 | 6/1991 | Hiraboyashi et al. | 430/557 |
| 5,024,932 | 6/1991 | Tanji et al. | 430/642 |
| 5,066,574 | 11/1991 | Kubota et al. | 430/557 |
| 5,091,294 | 2/1992 | Nishijima et al. | 430/557 |
| 5,215,877 | 6/1993 | Tomotake et al. | 430/557 |
| 5,219,716 | 6/1993 | Takada et al. | 430/557 |

FOREIGN PATENT DOCUMENTS

| | | |
|---|---|---|
| 283324 | 9/1988 | European Pat. Off. . |
| 3902711 | 8/1989 | Fed. Rep. of Germany . |

*Primary Examiner*—Charles L. Bowers, Jr.
*Assistant Examiner*—Geraldine Letscher
*Attorney, Agent, or Firm*—Jordan B. Bierman

[57] ABSTRACT

A silver halide photographic light-sensitive material is disclosed. The light-sensitive material comprises a support having thereon a photographic layer including a silver halide emulsion layer wherein the outermost surface of said photographic layer has a pH value of from 5.4 to 5.9 and said silver emulsion layer contains a compound represented by the following formula I;

(I)

wherein $R_1$ is an alkyl group, a cycloalkyl group or an aryl group; $R_2$ is an alkyl group, a cycloalkyl group, an acyl group or an aryl group; $R_3$ is a substituent, n is 0 or 1; $X_1$ is a substituent capable of splitting off upon coupling reaction with the oxidation product of a color developing agent; and $Y_1$ is an organic group. The light-sensitive material is excellent in stability during storage and gives stable photographic characteristics even when pH value of developer is varied.

6 Claims, No Drawings

SILVER HALIDE PHOTOGRAPHIC LIGHT-SENSITIVE MATERIAL

FIELD OF THE INVENTION

The present invention relates to a silver halide photographic light-sensitive material, hereinafter referred to as light-sensitive material, more specifically a light-sensitive material which is excellent in storage stability and stable to changes in pH of the color developer.

BACKGROUND OF THE INVENTION

Light-sensitive materials are distributed to users via various routes after production thereof. In the case of color printing paper, the light-sensitive material is often subject to various temperatures before reaching the photo-finisher and stored under non-refrigerating conditions due to the limited space even in the photo-finishing laboratory, even thougt an instruction for refrigerating storage is given. For this reason, the sensitivity and fogging at the time of use by the user often differ from those at delivery from the factory, which can hamper the obtainment of satisfactory performance. This is critical at increased levels of fogging, which can spoil the commercial value. Thus, there has been demand for a light-sensitive material with excellent storage stability at various temperatures in the photographic industry. In recent years, rapid processing of color photographic paper has been achieved by the use of silver halide grains with high silver chloride contents, as disclosed in WO87-04534; however, such silver halide grains are also known to be poor in the abovementioned storage stability. Japanese Patent Publication Open to Public Inspection (hereinafter referred to as Japanese Patent O.P.I. Publication) No. 6940/1990 discloses a technique for making the surface pH on the emulsion layer side of a light-sensitive material fall between 4.0 and 5.3 to solve the above problem. Specifically, each coating solution is adjusted with respect to pH and a carbamoylpyridium hardener and a bisformazinium hardener are used. However, analyses by the present inventor revealed that this method has no effect on sensitivity fluctuation, though it has a slight effect on fogging fluctuation. Also, the use of a large amount of a 1,3,5-triazine hardener has been found to improve fogging fluctuation in storage by making the surface pH of the emulsion layer fall in the range specified above, but the problem of sensitivity fluctuation remains unsolved. Another finding was that the use of a large amount of hardener tends to form an aggregate with gelatin, which damages the coating quality.

Generally, a silver halide color photographic light-sensitive material, hereinafter referred to as a color light-sensitive material, has a silver halide emulsion layer which has been spectrally sensitized to the desired sensitivity, wherein dye images are formed by reaction of yellow, magenta and cyan dye forming couplers in the silver halide emulsion and a color developing agent.

5-pyrazolone couplers, which have traditionally been used as magenta dye forming couplers, have major problems that yellow staining forms in the undeveloped portion in response to heat and moisture and the dye formed has undesirable absorption at around 430 nm which is undesirable from the viewpoint of color reproduction. The pyrazolobenzimidazoles described in British Patent No. 1,047,612, the indazolones described in U.S. Pat. No. 3,770,447 and the pyrazoloazoles described in U.S. Pat. No. 3,334,515, British Patent Nos. 1,252,418 and 1,334,515 and Japanese Patent O.P.I Publication Nos. 162548/1984 and 171956/1984 have very little undesirable absorption at around 430 nm and causes little Y staining due to heat or moisture.

On the other hand, there have recently been used yellow dye forming couplers which have little undesirable absorption on the long wavelength side of the spectral absorption characteristic of the dye and which offer good color reproduction, including the compound described in Japanese Patent O.P.I. Publication No. 123047/1988.

However, these magenta and yellow couplers change their color developability with changes in color developer pH, thus significantly affecting the properties, particularly gradation, of the color light-sensitive material.

SUMMARY OF THE INVENTION

The object of the present invention is to provide a silver halide photographic light-sensitive material free of the above problems in the prior art which is excellent in storage stability and offers stable gradation irrespective of color developer pH.

The above object of the present invention has been accomplished by a silver halide photographic light-sensitive material comprising a reflective support and a photographic layer including at least one silver halide emulsion layer formed thereon wherein pH of the outermost surface of the photographic layer is between 5.4 to 5.9 and the silver halide emulsion layer contains a compound represented by the following formula I:

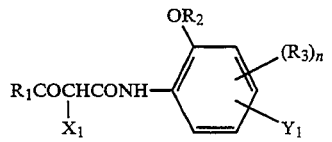

wherein $R_1$ represents an alkyl group, a cycloaryl group or an aryl group; $R_2$ represents an alkyl group, a cycloalkyl group, an acyl group or an aryl group; $R_3$ represents a group capable of being substituent of benzene ring; n represents 0 or 1; $X_1$ represents a hydrogen atom or a group capable of splitting off upon coupling with the oxidation product of a developing agent; $Y_1$ represents an organic group.

DETAILED DESCRIPTION OF TEE INVENTION

Any material can be used for the reflective support for the silver halide photographic light-sensitive material of the present invention, as long as it has thereon a waterproof resin layer containing a white pigment or it comprises a waterproof resin containing a white pigment. For example, vinyl chloride, polypropylene and polyethylene terephthalate supports containing a white pigment can be used. Polyolefins such as polyethylene and polypropylene can be used to form the waterproof resin layer, and the waterproof resin layer obtained by dispersing a white pigment in an acrylate monomer and setting this dispersion by electron beam can also be used. Paper supports having thereon a polyolefin layer containing a white pigment is preferable.

Inorganic and/or organic white pigments can be used for the reflective support relating to the present invention, with preference given to inorganic white pigments. Examples of such white pigments include sulfates of alkaline earth metals such as barium sulfate, carbonates of alkaline earth metals such as calcium carbonate, silicas such as fine power of silicic acid and synthetic silicates, calcium silicate, alumina, alumina hydrates, titanium oxide, zinc oxide, talc and clay, with preference given to barium sulfate and titanium oxide. For increasing the degree of dispersion, it is preferable to use an inorganic compound such as silica or aluminum oxide or a polyhydric alcohol such as 2,4-dihydroxy-2-methylpentane or trimethylolethane to surface treat these white pigments.

The amount of white pigment contained in the reflective support relating to the present invention is not less than 10% by weight in the waterproof resin layer. Lower amounts result in a lack of sharpness in details of the image. The amount is preferably not less than 13% by weight, more preferably not less than 15% by weight.

The degree of dispersion of the white pigment in the waterproof resin layer of the reflective support relating to the present invention can be determined by the method described in Japanese Patent O.P.I. Publication No. 28640/1990. First, the resin is sputtered by the ion sputtering method based on glow discharge to a depth of about 0.05 to 0.1 μm below the resin surface, and the exposed pigment micrograins are observed by electron microscopy to determine the projected area occupied thereby, and the area ratio is calculated. This calculation is made for several points on the reflective support, and the coefficient of variance is calculated from the mean and standard deviation of the obtained area ratio. Although it is preferable to have a large area of observation as the unit of calculation of area ratio and a larger number of observation fields, since data obtained become more accurate, a size of about 6×6 μm and about 6 to 10 fields are sufficient for practical use. The reflective support used in the light-sensitive material of the invention preferably has the degree of dispersion of white pigment is not more than 0.20 as of the above-defined coefficient of variance, preferably not more than 0.15 and more preferably not more than 0.10.

The surface pH of the silver halide photographic light-sensitive material of the present invention can be adjusted for one or more layers to such values that the desired surface pH is obtained before coating. For determining the surface pH, the light-sensitive material is kept standing at 23° C. and 55% RH for 24 hours, after which two drops of an aqueous solution of 0.3 M potassium nitrate are dropped on the surface using a pipette, and an electrode (GST-5213F) for measuring pH of membrane surface, produced by Toa Denpa K.K. is brought into contact, and after 3 minutes of equilibration, the pH value is read.

For adjusting the surface pH of the silver halide photographic light-sensitive material between 5.4 and 5.9, the amounts of addition of the vinyl sulfone hardener described below and the compound represented by the following formula III or IV, the emulsion temperature after coating and drying, humidity, heating time, etc. are altered as appropriate.

The silver halide photographic light-sensitive material of the present invention is applicable to both monocolor and multiple color light-sensitive materials. In a multi color light sensitive material for subtractive color reproduction of, the material is usually configured with silver halide emulsion layers each containing magenta, yellow and cyan couplers and non-light-sensitive layers laminated on a reflective support in an appropriate number of layers and order; which number of layers and order may be changed according to the target performance and purpose of use.

When the silver halide photographic light-sensitive material of the present invention is a multi-colored light-sensitive material, it is preferably configured with a support and a yellow dye forming layer, an intermediate layer, a magenta dye forming layer, an intermediate layer, a cyan dye forming layer, an intermediate layer, and a protective layer arranged on the support in this order.

The yellow coupler for the present invention is represented by the following formula I:

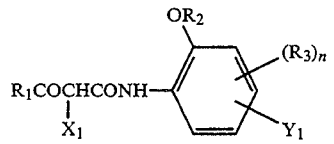

Formula I wherein $R_1$ represents an alkyl group, a cycloalkyl group or an aryl group; $R_2$ represents an alkyl group, a cycloalkyl group, an acyl group or an aryl group; $R_3$ represents a group capable of being substitutent of the benzene ring; n represents 0 or 1; $X_1$ represents a hydrogen atom or a group capable of splitting off upon coupling with the oxidation product of a developing agent; $Y_1$ represents an organic group.

With respect to formula I, alkyl groups represented by $R_1$ include a methyl group, an ethyl group, an isopropyl group, a t-butyl group and a dodecyl group. These alkyl groups include those having an additional substituent. Examples of the substituents include halogen atoms, aryl groups, alkoxy groups, aryloxy groups, alkylsulfonyl groups, acylamino groups and hydroxy groups.

Examples of cycloalkyl groups represented by $R_1$ include a cyclopropyl group, a cyclohexyl group and organic hydrocarbon residues condensed with two or more cycloalkyls (e.g., adamantyl group). Cycloalkyl groups represented by $R_1$ include those having a substituent. Examples of the substituents include those specified for the alkyl group represented by $R_1$.

The aryl group represented by $R_1$ is exemplified by a phenyl group, which aryl group includes those having a substituent. Examples of the substituents include the substituents specified for the alkyl group represented by $R_1$, and alkyl groups. $R_1$ is preferably a branched alkyl group.

With respect to formula I, the alkyl group, cycloalkyl group and aryl group represented by $R_2$ are exemplified by the same groups as specified for $R_1$, each including those having a substituent. Examples of the substituents include those specified for $R_1$. Examples of acyl groups include an acetyl group, a propionyl group, a butyryl group, a hexanoyl group and a benzoyl group, which acyl groups include those having a substituent.

$R_2$ is preferably an alkyl group or an aryl group, more preferably an alkyl group, and still more preferably a lower alkyl group having 5 or less carbon atoms.

With respect to formula I, examples of groups capable of being as a substituent of benzene ring represented by $R_3$ include a halogen atom such as a chlorine atom, alkyl groups such as an ethyl group, an isopropyl group and a t-butyl group, alkoxy groups such as a methoxy group, aryloxy groups such as a phenyloxy group, acyloxy groups such as an acetyloxy group and a benzoyloxy group, acylamino groups such as an acetamido group and a benzoylamino group, carbamoyl groups such as an N-methylcarbamoyl group and an N-phenylcarbamoyl group, alkylsulfonamido groups such as an ethylsulfonamido group, arylsulfonamido groups such as an phenylsulfonamido group, sulfamoyl groups such as an N-propylsulfamoyl group and an N-phenylsulfamoyl group and imido groups such as a succinimido group and a glutarimido group.

With respect to formula I, $Y_1$ represents an organic group, preferably represented by the following formula II:

Formula II $$-(J)_p-R_4$$

wherein $R_4$ represents an organic group having one binding group having a carbonyl or sulfonyl unit; p represents 0 or 1.

Examples of groups having a carbonyl unit include an ester group, an amide group, a carbamoyl group, an ureido group and an urethane group. Examples of groups having a sulfonyl unit include a sulfonyl group, a sulfonylamino group, a sulfamoyl group and an aminosulfonylamino group.

J represents $$-\underset{\underset{R_5}{|}}{N}CO-$$

or $$-\underset{\underset{R_5}{|}}{N}CON-;$$

$R_5$ represents a hydrogen atom, an alkyl group, an aryl group or a heterocyclic group.

The alkyl group represented by $R_5$ is exemplified by a methyl group, an ethyl group, an isopropyl group, a t-butyl group and a dodecyl group. The aryl group represented by $R_5$ is exemplified by a phenyl group and a naphthyl group. The heterocyclic group represented by $R_5$ is exemplified by a pyridyl group.

These groups represented by $R_5$ include those having a substituent. Typical examples of the substituent, which is not subject to limitation, include halogen atoms such as a chlorine atom, alkyl groups such as an ethyl group and a t-butyl group, aryl groups such as a phenyl group, a p-methoxyphenyl group and a naphthyl group, alkoxy groups such as an ethoxy group and a benzyloxy group, aryloxy groups such as a phenoxy group, alkylthio groups such as an ethylthio group, arylthio groups such as a phenylthio group, alkylsulfonyl groups such as a $\beta$-hydroxyethylsulfonyl group, arylsulfonyl groups such as a phenylsulfonyl group, acylamino groups including alkylcarbonylamino groups such as an acetoamido group and arylcarbonylamino groups such as a benzoylamino group, carbamoyl groups such as an N-methylcarbamoyl group and other alkylcarbamoyl groups and an N-phenylcarbamoyl group and other arylcarbamoyl groups, acyl groups including alkylcarbonyl groups such as an acetyl group and arylcarbonyl groups such as a benzoyl group, sulfonylamino groups including alkylsulfonylamino groups such as a methylsulfonamino group and arylsulfonylamino groups such as a phenylsulfonylamino group, sulfamoyl groups including alkylsulfamoyl groups such as an N-methylsulfamoyl group and arylsulfamoyl groups such as an N-phenylsulfamoyl group, a hydroxy group and a nitrile group.

With respect to formula I, the group represented by $X_1$, which is capable of splitting off upon coupling with the oxidation product of a developing agent, is exemplified by the group represented by the following formula III or IV, with preference given to the group represented by formula IV.

Formula III $$-OR_6$$

wherein $R_6$ represents an aryl group or heterocyclic group which may have a substituent.

Formula IV

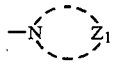

wherein $Z_1$ represents a group of non-metallic atoms necessary to form a 5- or 6-membered ring in cooperation with the nitrogen atom, which is exemplified by substituted or unsubstituted methylene and methine,

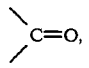

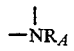

($R_A$ has the same definition as $R_5$ above), —N=, —O—, —S— and —$SO_2$—.

The yellow coupler represented by formula I may bind at the $R_1$, $R_3$ or $Y_1$ moiety to form a his-configuration.

The compound represented by the following formula V is particularly preferable for use as the yellow coupler of the present invention.

Formula V

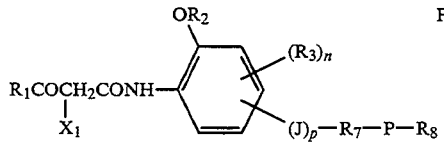

wherein $R_1$, $R_2$, $R_3$, $X_1$ and n have the same definitions as $R_1$, $R_2$, $R_3$, $X_1$ and n in formula I; J and p have the same definitions as J and p in formula II. $R_7$ represents an alkylene group, an arylene group, an alkylenearylene group, an arylenealkylene group or —A—$V_1$—B— (A and B independently represent an alkylene group, an arylene group, an alkylenearylene group or an arylenealkylene group; $V_1$ represents a divalent binding group); $R_8$ represents an alkyl group, a cycloalkyl group, an aryl group or a heterocyclic group. P represents a binding group including a carbonyl or sulfonyl unit.

With respect to formula V, the alkylene group represented by $R_7$, A or B is exemplified by a linear or branched alkylene group such as a methylene group, an ethylene group, a trimethylene group, a butylene group, a hexylene group, a methylmethylene group, an ethylethylene group, a 1-methylethylene group, a 1-methyl-2-ethylethylene group, a 2-decylethylene group or a 3-hexylpropylene group. The alkylene group includes those having a substituent, e.g., an aryl group, such as a 1-benzylethylene group, a 2-phenylethylene group and a 3-naphthylpropylene group.

Example arylene groups include a phenylene group and a naphthylene group, which may have a substituent.

Alkylenearylene groups include a methylenephenylene group, and arylenealkylene groups include a phenylenemethylene group, which groups may have a substituent. Examples of the divalent binding groups represented by $V_1$ include —O— and —S—.

Of the alkylene groups, arylene groups, alkylenearylene groups, arylenealkylene groups and —A—$V_1$—B— represented by $R_7$, alkylene groups are preferable.

With respect to formula V, the alkyl group represented by $R_8$ is exemplified by linear or branched alkyl groups such as an ethyl group, a butyl group, a hexyl group, an octyl group, a 2-ethylhexyl group, a dodecyl group, a hexadecyl group, a 2-hexyldecyl group and an octadecyl group. The cycloalkyl group is exemplified by a cyclohexyl group. The aryl group is exemplified by a phenyl group and a naphthyl group. The heterocyclic group is exemplified by a pyridyl group. These alkyl groups, cycloalkyl groups, aryl groups and heterocyclic groups represented by $R_8$ include those having an additional substituent. The substituent, which is not subject to limitation, includes the substituents specified for $R_5$ above. However, organic groups having a dissociating hydrogen atom having a pKa value of not more than 9.5, e.g., phenolic hydrogen atom, are undesirable as the substituent for $R_8$.

With respect to formula V, P represents a binding group having a carbonyl or sulfonyl unit, preferably one of the following groups VI, more preferably a binding group represented by one of the formulas 6 through 9.

$$-COO-, \quad 1)$$

-continued $$-\underset{\underset{R}{|}}{N}CO-, \quad 2)$$

$$-CO\underset{\underset{R}{|}}{N}-, \quad 3)$$

$$-\underset{\underset{R}{|}}{N}CO\underset{\underset{R'}{|}}{N}-, \quad 4)$$

$$-\underset{\underset{R}{|}}{N}COO-, \quad 5)$$

$$-SO_2-, \quad 6)$$

$$-\underset{\underset{R}{|}}{N}SO_2-, \quad 7)$$

$$-SO_2\underset{\underset{R}{|}}{N}-, \quad 8)$$

$$-\underset{\underset{R}{|}}{N}SO_2\underset{\underset{R'}{|}}{N}- \quad 9)$$

wherein R and R′ independently represent a hydrogen atom, an alkyl group, an aryl group or a heterocyclic group.

Groups represented by R and R′ include those specified for $R_5$ above, which groups may have a substituent. Example substituents include the substituents specified for $R_5$ above. R and R′ are preferably hydrogen atoms.

Preferably, the yellow coupler represented by formula I for the present invention is used in the range of $1\times10^{-3}$ to 1 mol, more preferably of $1\times10^{-2}$ to $8\times10^{-1}$ mol per mol of silver halide.

Examples of the yellow coupler represented by formula I above are given below.

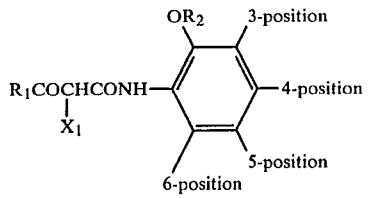
| No. | $R_1$ | $R_2$ | $X_1$ | 3-position | 4-position | 5-position | 6-position |
|---|---|---|---|---|---|---|---|
| Y-1 | (t)$C_4H_4$— | —$CH_3$ | 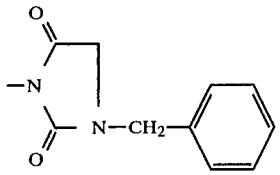 | —H | —H | —$NHCO(CH_2)_3O$— 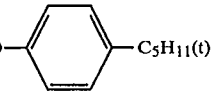 —$C_5H_{11}$(t) | —H |
| Y-2 | (t)$C_4H_9$— | —$CH_3$ | 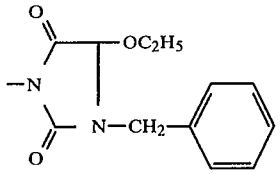 | —H | —H | 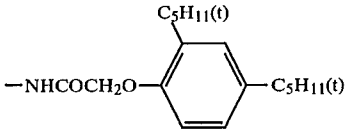 | —H |
| Y-3 | (t)$C_4H_9$— | —$CH_3$ | 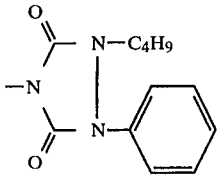 | —H | —H | —$NHCOCH(CH_3)CH_2SO_2C_{12}H_{25}$ | —H |
| Y-4 | (t)$C_4H_9$— | —$CH_3$ | 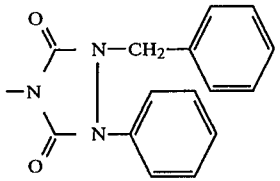 | —H | —H | 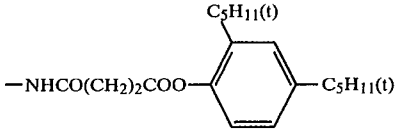 | —H |

-continued
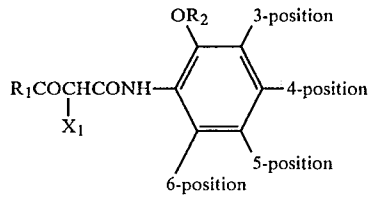
| No. | $R_1$ | $R_2$ | $X_1$ | 3-position | 4-position | 5-position | 6-position |
|---|---|---|---|---|---|---|---|
| Y-5 | (t)$C_4H_9$— | —$CH_3$ | 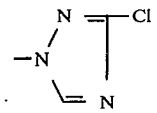 | —H | —H | 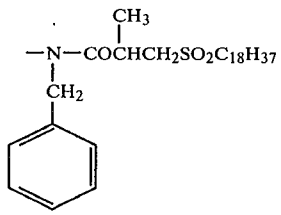 | —H |
| Y-6 | (t)$C_4H_9$— | —$CH_3$ | 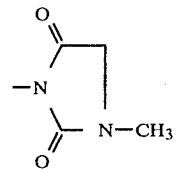 | —H | —H | —$NHCOCH(CH_3)CH_2SO_2C_{12}H_{25}$ | —H |
| Y-7 | (t)$C_4H_9$— | —$CH_3$ | 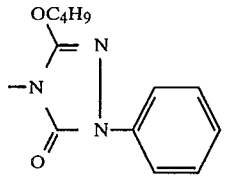 | —H | —H | —$NHCO(CH_2)_2CONH(C_2H_5)C_{12}H_{25}$ | —H |
| Y-8 | (t)$C_4H_9$— | —$C_3H_7$(iso) | 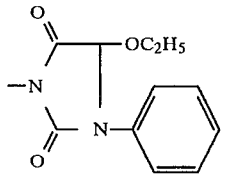 | —H | —H | —$CONH(CH_2)_3CONH$— 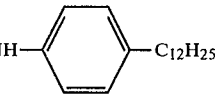 —$C_{12}H_{25}$ | —H |

-continued
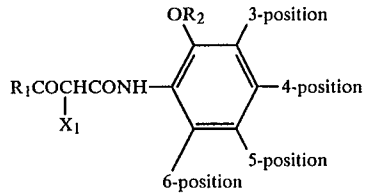
| No. | $R_1$ | $R_2$ | $X_1$ | 3-position | 4-position | 5-position | 6-position |
|---|---|---|---|---|---|---|---|
| Y-9 | (t)$C_4H_9$— | —$CH_3$ | 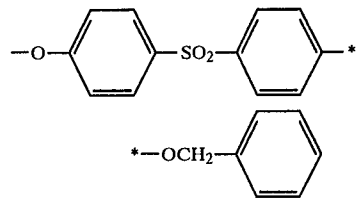 | —H | —H | 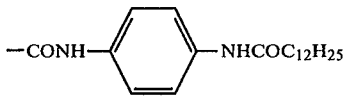 | —H |
| Y-10 | (t)$C_4H_9$— | —$C_{12}H_{25}$ | 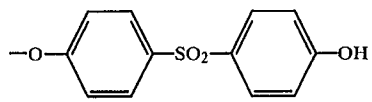 | —H | —H | —$CONHCH(CH_3)CH_2SO_2C_2H_5$ | —H |
| Y-11 | (t)$C_4H_9$— | —$C_{18}H_{37}$ | 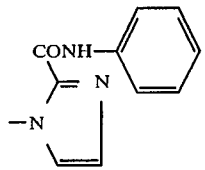 | —H | —H | —$NHCOC(CH_3)_2CH_2SO_2C_4H_9$ | —H |
| Y-12 | (t)$C_4H_9$— | —$CH_3$ | 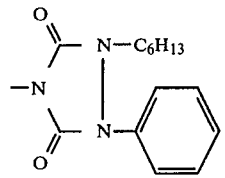 | —H | —H | 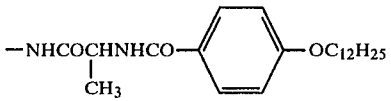 | —H |

-continued
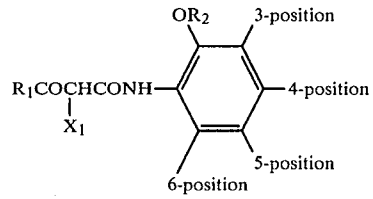
| No. | $R_1$ | $R_2$ | $X_1$ | 3-position | 4-position | 5-position | 6-position |
|---|---|---|---|---|---|---|---|
| Y-13 | (t)$C_4H_9$— | —$C_4H_9$ | 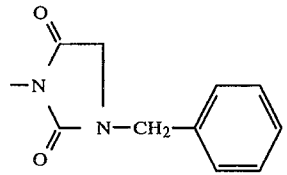 | —H | —H | 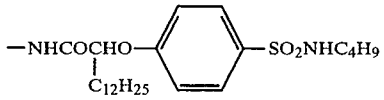 | —H |
| Y-14 | (t)$C_4H_9$— | $CH_3$ | 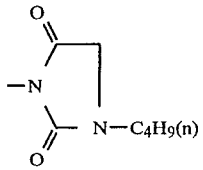 | —H | —H | —NHCOCH($CH_3$)$CH_2SO_2C_{12}H_{25}$ | —H |
| Y-15 | (t)$C_4H_9$— | —$CH_3$ | 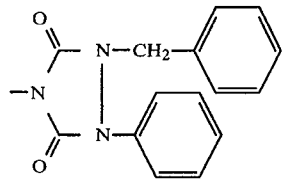 | —H | —H | —$CONH(CH_2)_2NHSO_2C_{12}H_{25}$ | —H |
| Y-16 | (t)$C_4H_9$— | —$CH_3$ | 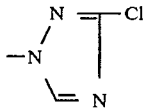 | —H | —H | —CONHCH($CH_3$)$CH_2SO_2CH_2$CH($C_6H_{13}$)$C_8H_{17}$ | —H |

-continued
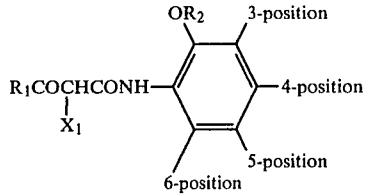
| No. | $R_1$ | $R_2$ | $X_1$ | 3-position | 4-position | 5-position | 6-position |
|---|---|---|---|---|---|---|---|
| Y-17 | (t)$C_4H_9$— | —$CH_3$ | 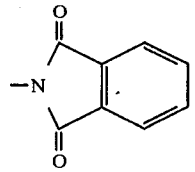 | —H | —H | 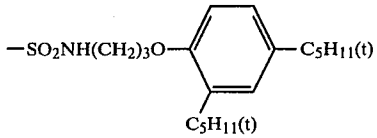 | —H |
| Y-18 | (t)$C_4H_9$— | —$CH_3$ | 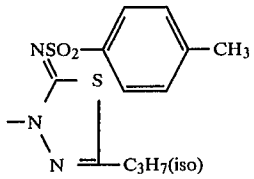 | —H | —H | 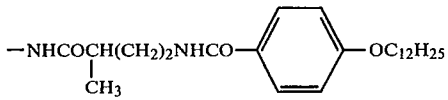 | —H |
| Y-19 | $C_2H_5OCH_2C(CH_3)_2$— | —$CH_3$ | 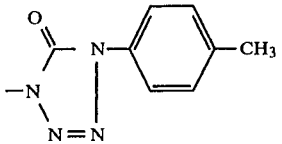 | —H | —H | —$NHCO(CH_2)_{10}COOC_2H_5$ | —H |
| Y-20 | (t)$C_4H_9$— | —$CH_3$ | 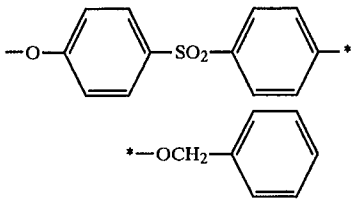 | —H | —H | 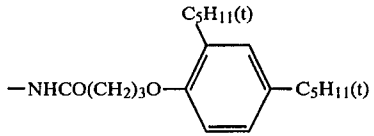 | —H |

-continued
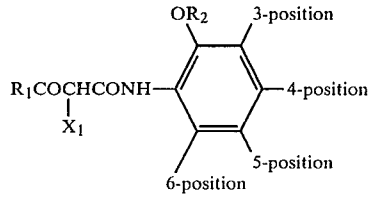
| No. | $R_1$ | $R_2$ | $X_1$ | 3-position | 4-position | 5-position | 6-position |
|---|---|---|---|---|---|---|---|
| Y-21 | (t)$C_4H_9$— | —$CH_3$ | 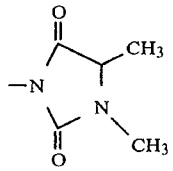 | —H | —H | —NHCO$CH(CH_3)CH_2SO_2C_{12}H_{25}$ | —H |
| Y-22 | (t)$C_4H_9$— | —$CH_3$ | 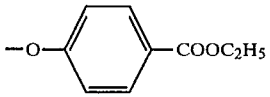 | —H | —H | 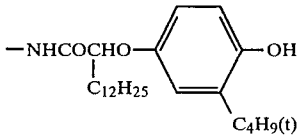 | —H |
| Y-23 | (t)$C_4H_9$— | —$C_{12}H_{25}$ | 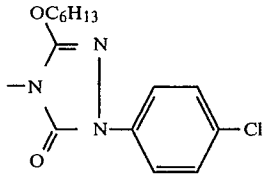 | —H | —H | —NHCO$(CH_2)_2SO_2NHCH_2CH(C_2H_5)C_4H_9$ | —H |
| Y-24 | (t)$C_4H_9$— | —$C_2H_5$ | 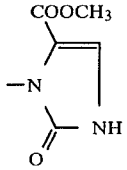 | —H | —H | 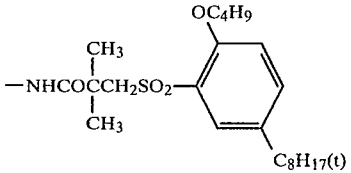 | —H |

-continued
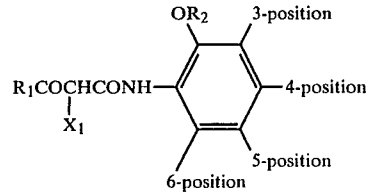
| No. | $R_1$ | $R_2$ | $X_1$ | 3-position | 4-position | 5-position | 6-position |
|---|---|---|---|---|---|---|---|
| Y-25 | 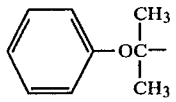 | $-C_4H_9$ | 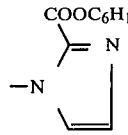 | —H | —H | $-NHSO_2C_16H_{33}$ | —H |
| Y-26 | $(t)C_5H_{11}$ | $-C_2H_5$ | —H | —H | —H | 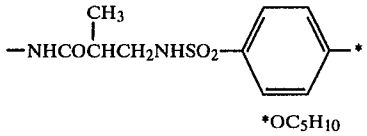 | —H |
| Y-27 | $(t)C_4H_9$— | $-CH_3$ | 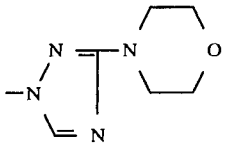 | —H | —H | 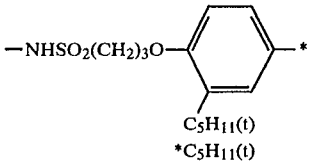 | —H |
| Y-28 | $(t)C_4H_9$— | $-C_{18}H_{37}$ | 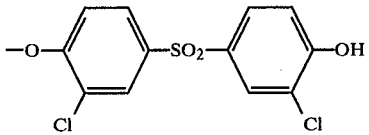 | —H | —H | 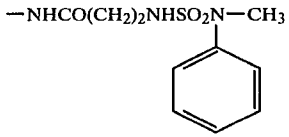 | —H |
| Y-29 | $(t)C_4H_9$— | $-CH_3$ | 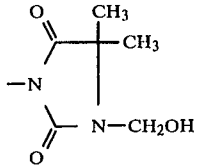 | —H | —H | 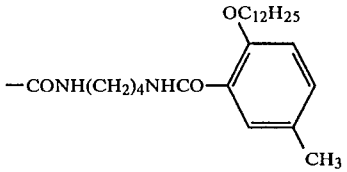 | —H |

-continued
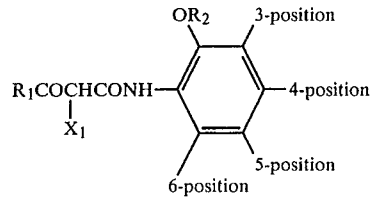
| No. | $R_1$ | $R_2$ | $X_1$ | 3-position | 4-position | 5-position | 6-position |
|---|---|---|---|---|---|---|---|
| Y-30 | (t)$C_4H_9$— | —$CH_3$ | 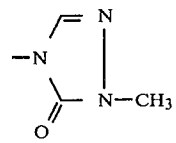 | —H | —H | —CONHCH($C_6H_{13}$)$CH_2SO_2NHC_{12}H_{25}$ | —H |
| Y-31 | (t)$C_4H_9$— | —$CH_3$ | 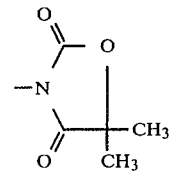 | —H | —H | —$COOC_{14}H_{29}$(n) | —H |
| Y-32 | 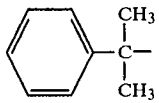 | —$C_{12}H_{25}$ | 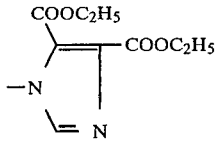 | —H | —H | —$NHCO(CH_2)_3NHCONHCH_2CH(C_2H_5)C_4H_9$ | —H |
| Y-33 | (t)$C_5H_{11}$— | —$CH_3$ | 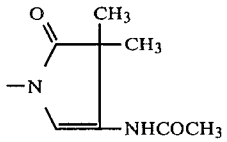 | —H | —H | —CONHCH($C_6H_{13}$)$CH_2$CONH— 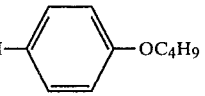 —$OC_4H_9$ | —H |
| Y-34 | (t)$C_4H_9$— | —$CH_3$ | 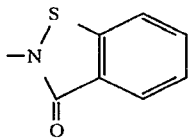 | —H | —H | —$COOC_{18}H_{35}$ | —H |

-continued
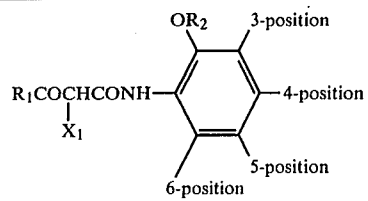
| No. | $R_1$ | $R_2$ | $X_1$ | 3-position | 4-position | 5-position | 6-position |
|---|---|---|---|---|---|---|---|
| Y-35 | (t)$C_4H_9$— | —$CH_3$ | 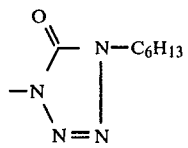 | —H | —H | —$NHCO(CH_2)_3NHCOCH_2CH(C_8H_{17})C_6H_{13}$ | —H |
| Y-36 | (t)$C_4H_9$— | —$CH_3$ | 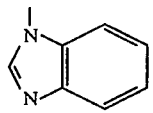 | —H | —Cl | —$NHCOC(CH_3)_2CH_2NHCON(C_{12}H_{25})(C_2H_5)$ | —H |
| Y-37 | (t)$C_4H_9$— | 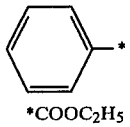 *$COOC_2H_5$ | 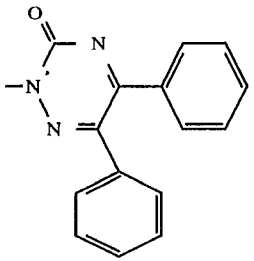 | —H | —H | —$CONHCH_2CH(C_2H_5)SO$— 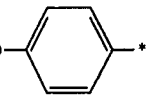 *$C_{18}H_{37}$ | —H |
| Y-38 | (t)$C_4H_9$— | —$C_4H_9$ | 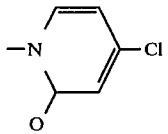 | —H | —$NHCOCH(C_{16}H_{33})SO_2NHC_{12}H_{25}$ | —Cl | —H |

-continued
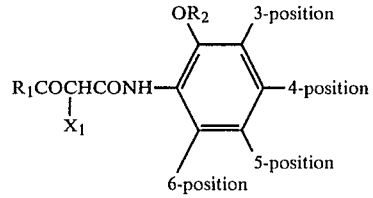
| No. | $R_1$ | $R_2$ | $X_1$ | 3-position | 4-position | 5-position | 6-position |
|---|---|---|---|---|---|---|---|
| Y-39 | (t)$C_4H_9$— | —$CH_3$ | 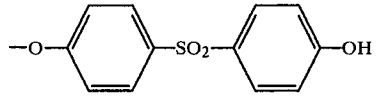 | —H | —Cl | 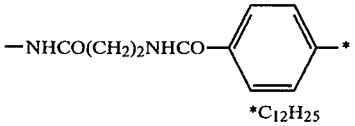 | —H |
| Y-40 | (t)$C_4H_9$— | 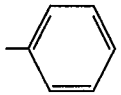 | 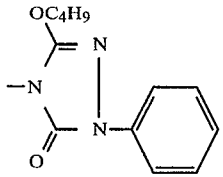 | —H | —H | 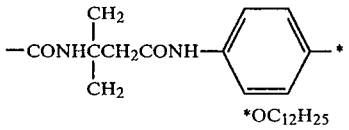 | —H |
| Y-41 | (t)$C_5H_{11}$ | 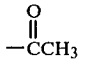 | 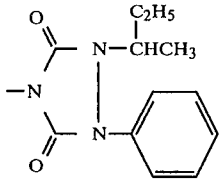 | —H | —$OCH_3$ | 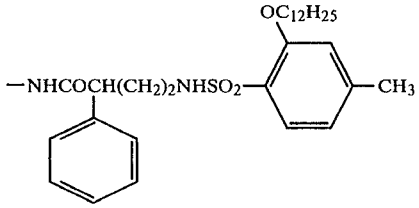 | —H |
| Y-42 | (t)$C_4H_9$— | 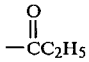 | 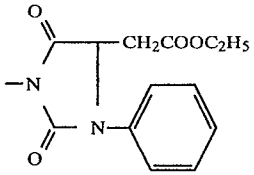 | —H | —H | 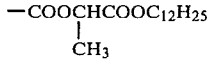 | —H |

-continued
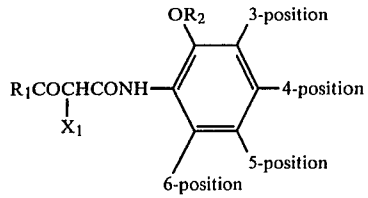
| No. | $R_1$ | $R_2$ | $X_1$ | 3-position | 4-position | 5-position | 6-position |
|---|---|---|---|---|---|---|---|
| Y-43 | (t)$C_4H_9$— | —$CH_3$ | 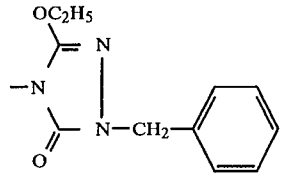 | —H | —H | 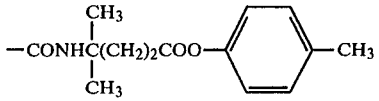 | —H |
| Y-44 | (t)$C_4H_9$— | —$CH_3$ | 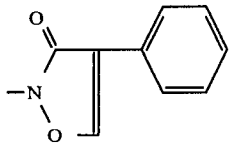 | —H | —$CONH(CH_2)_4NHSO_2CH(CH_3)C_4H_9$ | —$OCH_3$ | —H |
| Y-45 | (t)$C_4H_9$— | —$CH_3$ | 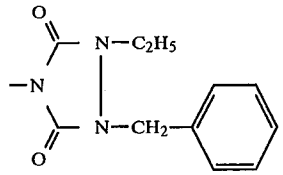 | —H | —H | 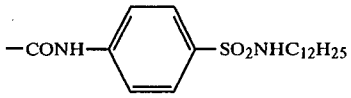 | —H |
| Y-46 | (t)$C_4H_9$— | —$CH_3$ | 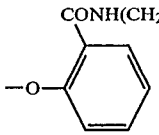 | —H | —H | 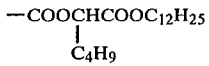 | —H |

-continued
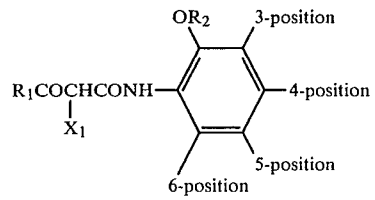
| No. | $R_1$ | $R_2$ | $X_1$ | 3-position | 4-position | 5-position | 6-position |
|---|---|---|---|---|---|---|---|
| Y-47 | $(t)C_4H_9$— | —$CH_3$ | 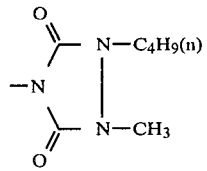 | —H | —H | —$NHCO\overset{CH_3}{\overset{\vert}{C}}HCH_2SO_2C_{12}H_{25}$ | —H |
| Y-48 | 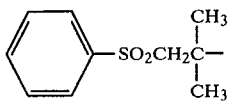 | —$C_2H_5$ | 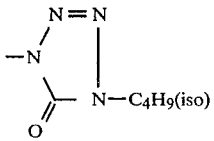 | —H | —H | —$NHCO(CH_2)_3CON(C_6H_{13})CH_2$ 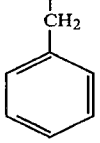 | —H |
| Y-49 | $(t)C_4H_9$— | 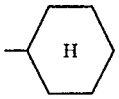 | 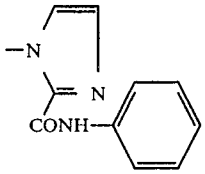 | —H | —H | 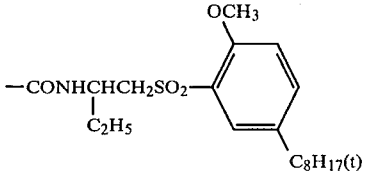 | —H |
| Y-50 | 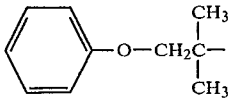 | —$CH_3$ | 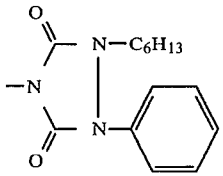 | —H | —H | —$CONH\overset{C_2H_5}{\overset{\vert}{C}}HCOOC_{12}H_{25}$ | —H |

-continued
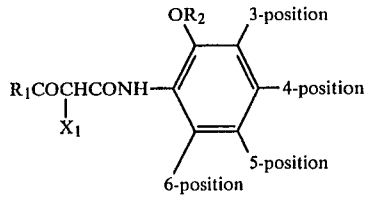
| No. | $R_1$ | $R_2$ | $X_1$ | 3-position | 4-position | 5-position | 6-position |
|---|---|---|---|---|---|---|---|
| Y-51 | (iso)$C_3H_7$— | —$C_4H_9$ | 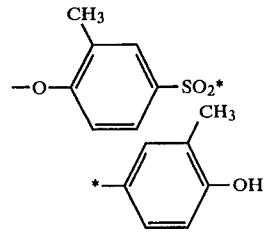 | —H | —H | 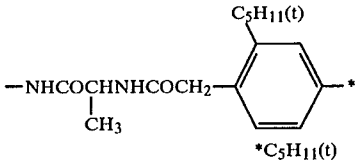 | —H |
| Y-52 | 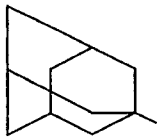 | —$CH_3$ | 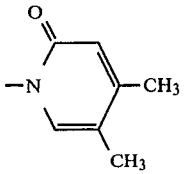 | —H | —H | —$NHCO(CH_2)_{10}COOC_2H_5$ | —H |
| Y-53 | 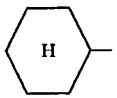 | —$CH_3$ | 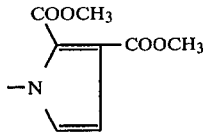 | —H | —H | 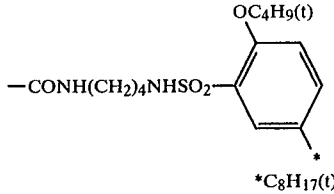 | —H |
| Y-54 | 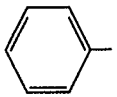 | —$CH_3$ | 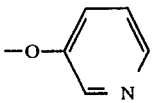 | —H | —H | —$NHCO(CH_2)_2NHCONHCH_2O$* 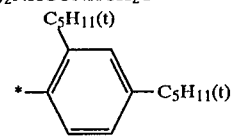 | —H |

-continued
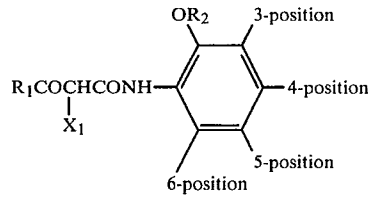
| No. | $R_1$ | $R_2$ | $X_1$ | 3-position | 4-position | 5-position | 6-position |
|---|---|---|---|---|---|---|---|
| Y-55 | (t)$C_4H_9$— | —$C_{16}H_{33}$(n) | 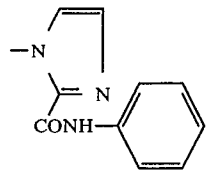 | —H | —H | —$SO_2NHCOC_2H_5$ | —H |
| Y-56 | (t)$C_4H_9$— | —$CH_3$ | 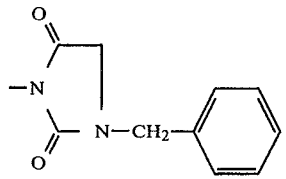 | —H | —H | —$NHCOCH_2CH_2NHCOOC_{12}H_{25}$ | —H |

Magenta couplers which can be used are 5-pyrazolone couplers, pyrazolobenzimidazole couplers, pyrazoloazole couplers and open-chain acylacetonitrile couplers, with preference given to the coupler represented by the following formula M-I:

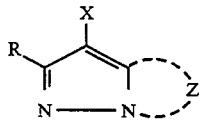

Formula M-I wherein Z represents a group of non-metallic atoms necessary to form a nitrogen-containing heterocycle, which ring may have a substituent.

X represents a hydrogen atom or a group capable of splitting off upon reaction with the oxidation product of a color developing agent. R represents a hydrogen atom or a substituent.

With respect to formula M-I above, the substituent represented by R is not subject to limitation. Typical examples include alkyls, aryls, anilinos, acylaminos, sulfonamides, alkylthios, arylthios, alkenyls, cycloalkyls, halogen atoms, cycloalkenyls, alkinyls, heterocyclic rings, sulfonyls, sulfinyls, phosphonyls, acyls, carbamoyls, sulfamoyls, cyanos, alkoxys, aryloxys, heterocyclic oxys, siloxys, acyloxys, carbamoyloxys, aminos, alkylaminos, imidos, ureidos, sulfamoylaminos, alkoxycarbonylaminos, aryloxycarbonylaminos, alkoxycarbonyls, aryloxycarbonyls, heterocyclic thios, spiro compound residues and bridged hydrocarbon compound residues.

With respect to the substituent represented by R, the group capable of splitting off upon reaction with the oxidation product of a color developing agent, the nitrogen-containing heterocyclic group and the substituent which may have a ring structure formed by Z, the preferable range, examples, and the preferable range of the magenta coupler represented by formula M-I are the same as those specified on line 18, page 3 to line 7, page 6 of European Patent Publication No. 0273712.

Typical examples of the magenta coupler represented by formula M-I are given below.

M-1

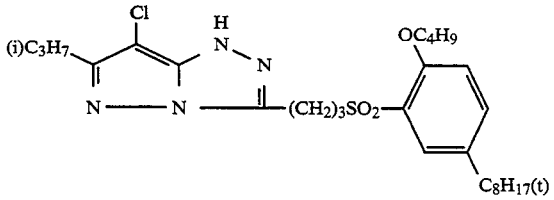

M-2

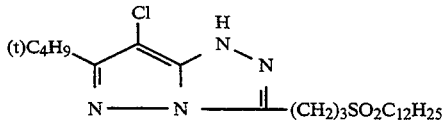

M-3

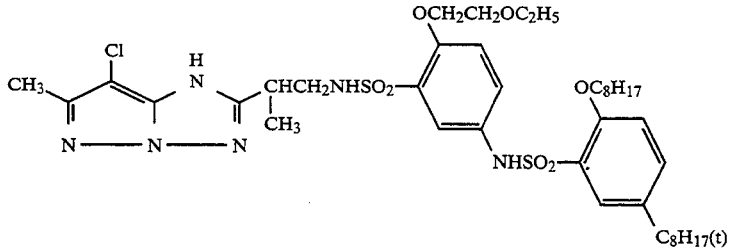

M-4

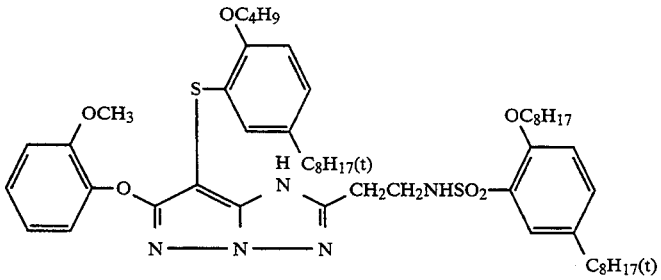

M-5

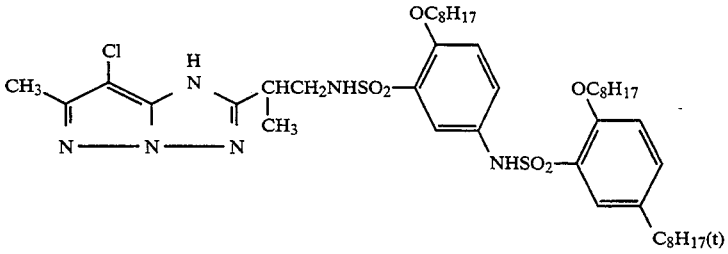

-continued
M-6
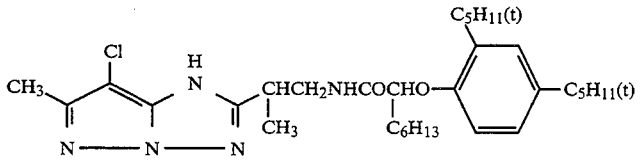
M-7
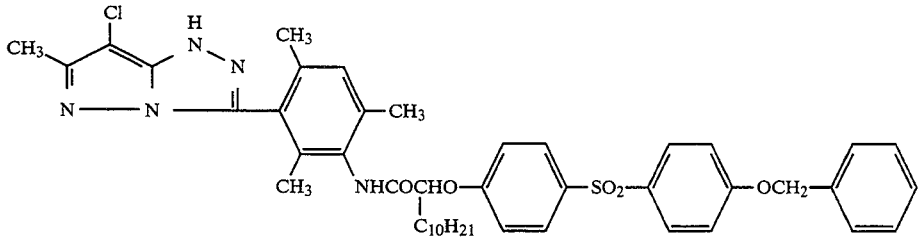
M-8
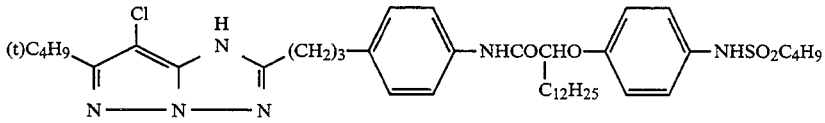
M-9
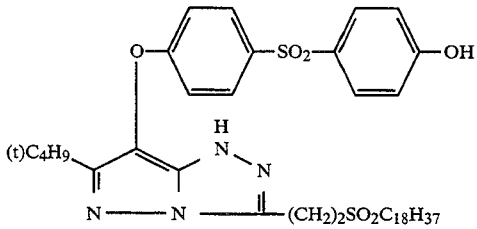
M-10
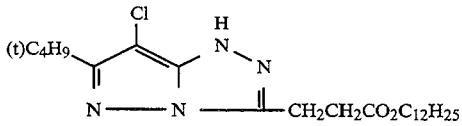
M-11
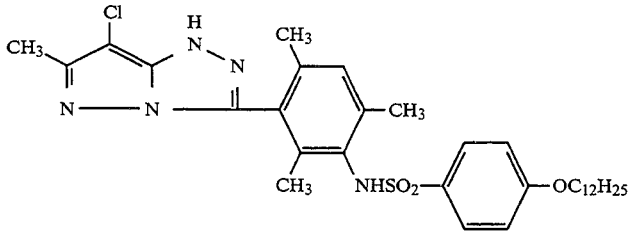
M-12
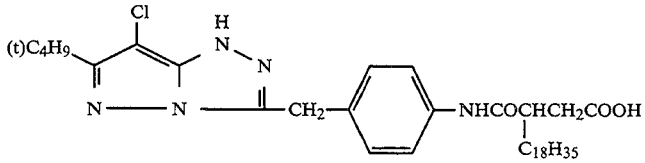
M-13
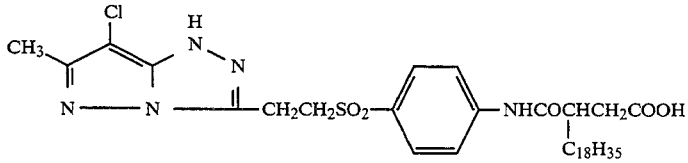
M-14
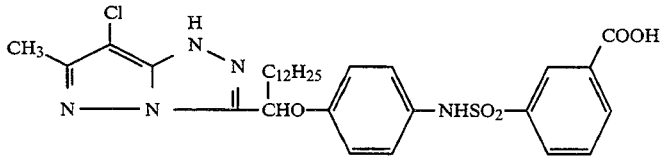

-continued

M-15

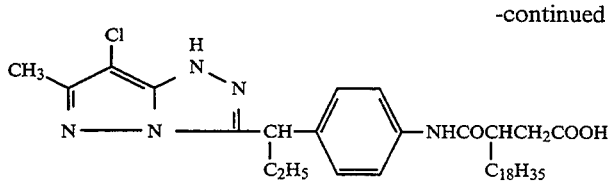

M-16

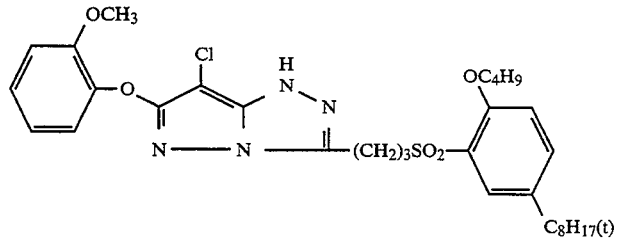

M-17

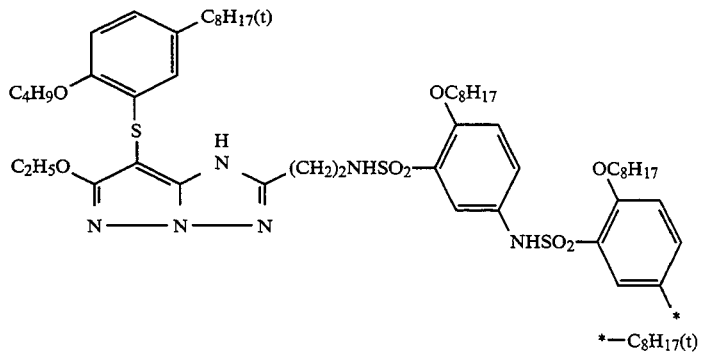

M-18

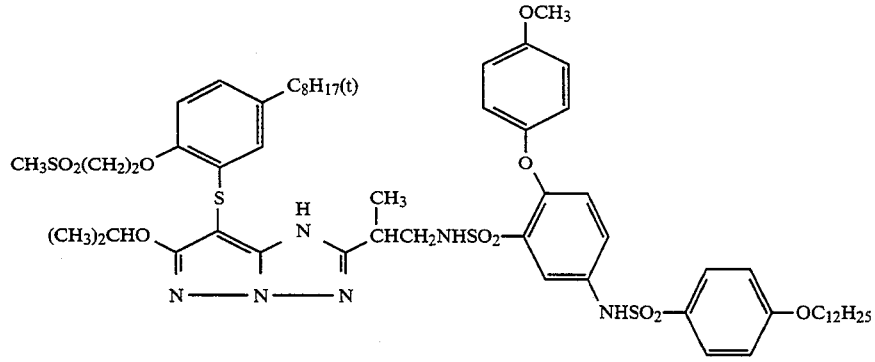

M-19

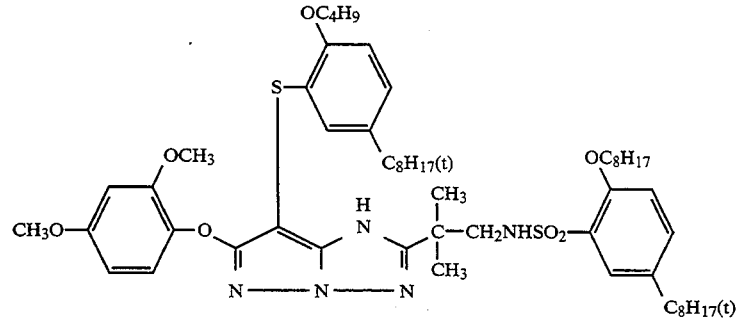

Other examples are compounds M-1 through M-61 described on pages 6–21 of European Patent Publication No. 0273712 and compounds 1 through 223 described on pages 36-92 of European Patent Publication No. 0235913 except for those specified above.

These couplers can be synthesized in accordance with the Journal of the Chemical Society, Perkin I (1977), 2047–2052, U.S. Pat. No. 3,725,067 and Japanese Patent O.P.I. Publication Nos. 99437/1984, 42045/1983, 162548/1984, 171956/1984, 33552/1985, 43659/1985, 172982/1985, 190779/1985, 209457/1987 and 307453/1988.

The above-mentioned couplers can be used in combination with other kinds of magenta coupler, and can be used in the content range usually of $1\times10^{-3}$ to 1 mol, preferably of $1\times10^{-2}$ to $8\times10^{-1}$ mol per mol of silver halide.

As cyan couplers, phenol-based or naphthol-based couplers are commonly used. These cyan couplers are described in U.S. Pat. Nos. 2,369,992, 2,439,272, 2,698,974, 3,034,892 and 2,839,044 and Japanese Patent O.P.I. Publication Nos. 3742/1972, 112038/1975 and 130441/1975 and other publications.

The grains contained in the silver halide emulsion layer of the present invention are chemically sensitized by a conventional method. Specifically, sulfur sensitization, which uses a compound containing sulfur capable of reacting with silver ions or active gelatin, selenium sensitization, which uses a selenium compound, reduction sensitization, which uses a reducing agent, and noble metal sensitization, which uses gold or other noble metal compounds, can be used singly or in combination. Simple sulfur sensitization or a combination of sulfur sensitization and gold sensitization is preferable, and simple sulfur sensitization is particularly preferable.

In the present invention, sulfur sensitizers for sulfur sensitization include elemental sulfur, thiosulfates, allyl thiocarbazide, thiourea, allyl isothiocyanate, cystine, p-toluenethiosulfonate and rhodanine. The sulfur sensitizers described in U.S. Pat. Nos. 1,574,944, 2,410,689, 2,278,947, 2,728,668, 3,501,313 and 3,656,955, West German Patent OLS No. 1,422,869, and Japanese Patent O.P.I. Publication Nos. 24937/1981 and 45016/1980 can also be used. Although the amount of sulfur sensitizer added varies in a considerable range depending upon various factors such as pH, temperature and silver halide grain size, it is preferable to add the sulfur sensitizer at about $10^{-7}$ to $10^{-1}$ mol per mol of silver halide.

In the present invention, various gold compounds can be used as gold sensitizers, whether the valency of gold is monovalent (+1) or trivalent (+3). Typical examples of such gold compounds include chloroauric acid, potassium chloroaurate, auric trichloride, potassium auric thiocyanate, potassium iodoaurate, tetracyanoauric acid, ammonium aurothiocyanate and pyridyl trichlorogold.

Although the amount of gold sensitizer added varies depending on various factors, it is preferable to add the gold sensitizer at $5\times10^{-7}$ to $5\times10^{-3}$ tool, more preferably $2\times10^{-6}$ to $1\times10^{-4}$ per mol of silver halide.

Chemical sensitization of silver halide grains of the present invention can preferably be performed in the presence of elemental sulfur. The term elemental sulfur means single substance sulfur, forming no compound with any other element. Elemental sulfur may be added at a time after the chemical sensitization if it is required.

Therefore, the sulfur-containing compounds known as photographic additives in the photographic industry, such as sulfides, sulfuric acid or salts thereof, sulfurous acid or salts thereof, thiosulfuric acid or salts thereof, sulfonic acid or salts thereof, thioether compounds, thiourea compounds, mercapto compounds and sulfur-containing heterocyclic compounds, are not included in the scope of elemental sulfur in the present invention.

Some allotropes of the single substance of sulfur, which is used as elemental sulfur in the present invention, are known, any of which can be used for the present invention.

Of the above allotropes, α-sulfur, belonging to the orthorhombic system, is stable at room temperature; it is preferable to use such α-sulfur for the present invention.

When using elemental sulfur, it may be used as a solid as such, but it is preferable to use it in the form of a solution. Elemental sulfur is known to be insoluble in water but soluble in carbon disulfide, sulfur chloride, benzene, diethyl ether, ethanol and other solvents. It is preferable to add elemental sulfur to emulsion after dissolving it in these solvents. Of these elemental sulfur solvents, ethanol is particularly preferably used from the viewpoint of handling and photographic influence.

Although the amount of elemental sulfur added to emulsion varies depending on the kind of silver halide emulsion, the degree of expected effect and other factors, it is in the range of $1\times10^{-5}$ to 10 mg, preferably of $1\times10^{-3}$ to 5 mg per mol of silver halide.

Elemental sulfur is added in any process optionally selected out of the processes for the production of silver halide photographic light-sensitive material, i.e., the silver halide grain forming process, the chemical sensitization process (also referred to as chemical ripening process), the coating solution preparing process and the coating and drying process. In the silver halide grain forming process, elemental sulfur may be added before silver halide crystal nucleation, or crystal growth may be conducted in the presence of elemental sulfur, or elemental sulfur may be added upon completion of nucleation or before or after removal of excess salts after completion of crystal growth.

When elemental sulfur is added in the chemical sensitization process, it is added upon initiation of chemical sensitization (when the chemical sensitizer has been added) or during and upon completion of chemical sensitization (when a chemical sensitization stopper has been added). It is added at any time between completion of chemical sensitization and coating.

When elemental sulfur is added during the coating solution preparing process, coating solution is prepared by mixing a silver halide emulsion, a coupler dispersion and if necessary various additives such as aqueous gelatin, surfactant, thickening agent, hardener, dye and developing inhibitor. It is added any time between completion of chemical sensitization and coating.

Preferably, elemental sulfur is added in the initial stage of chemical sensitization to conduct chemical sensitization and/or spectral sensitization in the presence of elemental sulfur, or elemental sulfur is added upon completion of chemical sensitization.

The chemical sensitization process includes the chemical sensitization initiating process, in which a chemical sensitizer is added, the time when the chemical sensitizer is added is the time of initiation of chemical sensitization, and the chemical sensitization stopping process, in which a chemical sensitization stopping agent is added. In this case, elemental sulfur may be added any time, as long as it is substantially during the chemical sensitization stopping process, specifically including the addition time of the chemical sensitization stopping agent or time when chemical sensitization has stopped, or 10 minutes before or after thereof, preferably at the time of or 5 minutes before or after addition.

The surface pH of the light-sensitive material of the invention can be adjusted by addition of various kinds of acidic or alkaline agents to an emulsion layer and/or another non-light sensitive layer. Hardeners added to the photographic layer can also be applied for controlling the surface pH of the light-sensitive material.

Vinyl sulfone hardeners and the compounds represented by the following formulas H-I and H--II are desirable for the present invention.

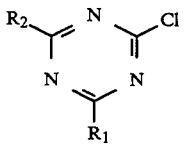

Formula H-I wherein $R_1$ represents a chlorine atom, a hydroxy group, an alkyl group, an alkoxy group, an alkylthio group, an $-OM_1$ group in which $M_1$ represents a monovalent metal atom, an $-NR_5R_6$ group in which $R_5$ and $R_6$ independently represent a hydrogen atom, an alkyl group or an aryl group, or an $-NHCOR_7$ group in which $R_7$ represents a hydrogen atom, an alkyl group or an aryl group; $R_2$ represents the same group as specified for $R_1$ above except for chlorine atom.

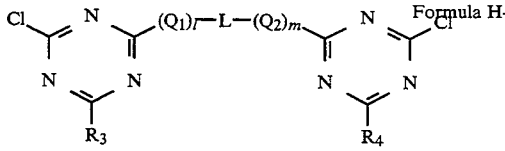

Formula H-II wherein $R_3$ and $R_4$ independently represent a chlorine atom, a hydroxy group, an alkyl group, an alkoxy group or an $-OM_1$ group in which $M_1$ represents a monovalent metal atom. $Q_1$ and $Q_2$ independently represent a binding group selected from —O—, —S— or —NH—; L represents an alkylene group or an arylene group; 1 and m independently represent 0 or 1.

Examples of the vinyl sulfone hardener for the present invention include aromatic compounds such as those described in German Patent No. 1,100,942, alkyl compounds bound via hetero atom such as those described in Japanese Patent Examined Publication Nos. 29622/1969 and 25373/1972, sulfonamide ester compounds such as those described in Japanese Patent Examined Publication No. 8736/1972, 1,3,5-tris[β-(vinylsulfonyl)propionyl]-hexahydro-s-triazine compounds such as those described in Japanese Patent O.P.I. Publication No. 24435/1974 and alkyl compounds such as those described in Japanese Patent O.P.I. Publication No. 44164/1976.

Typical examples thereof are given below.

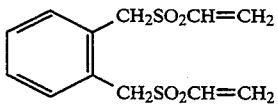

H-1

$O(CH_2CH_2SO_2CH{=}CH)_2$ H-2

$NH(CH_2CH_2SO_2CH{=}CH_2)_2$ H-3

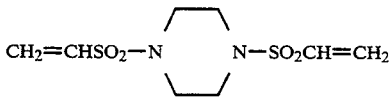

H-4

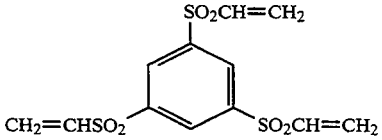

H-5

-continued

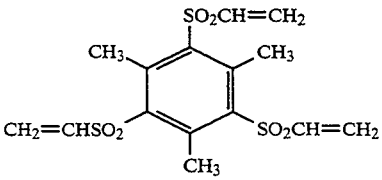

H-6

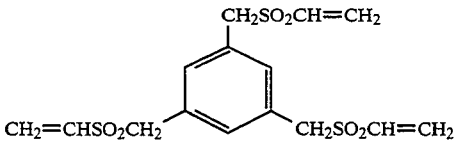

H-7

$CH_3C(CH_2OCH_2SO_2CH{=}CH_2)_3$ H-8

$C(CH_2OCH_2SO_2CH{=}CH_2)_4$ H-9

$N(CH_2CH_2OCH_2SO_2CH{=}CH_2)_3$ H-10

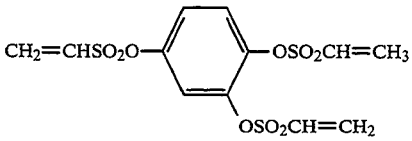

H-11

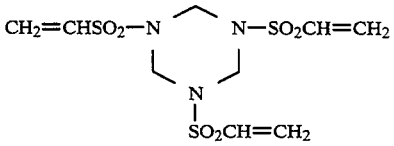

H-12

$C_2H_5C(CH_2SO_2CH{=}CH_2)_3$ H-13

$C_8H_17C(CH_2SO_2CH{=}CH_2)_3$ H-14

$CH_2{=}CHSO_2CH_2CH(CH_2SO_2CH{=}CH_2)CH_2SO_2CH{=}CH_2$ H-15

$(CH_2{=}CHSO_2CH_2)_3CCH_2Br$ H-16

$(CH_2{=}CHSO_2CH_2)_2CHCH(CHSO_2CH_2{=}CH_2)_2$ H-17

$(CH_2{=}CHSO_2CH_2)_3CCH_2OCH_2C(CH_2SO_2CH{=}CH_2)_3$ H-18

$C(CH_2SO_2CH{=}CH_2)_3$ H-19

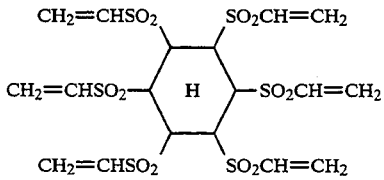

H-20

$(CH_2{=}CHSO_2CH_2)_3CCH_2SO_2CH_2CH_2Cl$ H-21

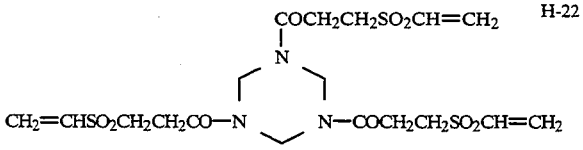

H-22

In addition to the above exemplified compounds, vinyl sulfone hardeners for the present invention include compounds having at least three vinyl sulfone groups in their molecular structure, such as reaction products obtained by reacting Exemplified Compounds H-5 through H-22 with compounds having a group reactive to vinyl sulfone group and a water-solublizing group, such as diethanolamine, thioglycolic acid, sodium salt of sarcosine and sodium salt of taurine.

The compounds represented by formulas H-I and H-II are described in detail below.

With respect to formulas H-I and H-II, alkyl groups, alkoxy groups and alkylthio groups represented by $R_1$ include alkyl groups having 1 to 3 carbon atoms, such as a methyl group, an ethyl group, a methoxy group, an ethoxy group, a methylthio group and an ethylthio group.

Monovalent metal atoms of $M_1$ in the —$OM_1$ group represented by $R_1$ is exemplified by sodium, potassium and ammonium. Alkyl groups represented by $R_5$ and $R_6$ in the —$NR_5R_6$ group include alkyl groups having 1 to 3 carbon atoms such as a methyl group and an ethyl group, and aryl groups of $R_6$ include a phenyl group.

The alkyl group and aryl group represented by $R_7$ in the —$NHCOR_7$ represented by $R_1$ have the same definitions as the alkyl group and aryl group represented by the above $R_5$ and $R_6$.

$R_2$ has the same definition as $R_1$ above except for the chlorine atom.

Groups represented by $R_3$ and $R_4$ are the same as those specified for $R_1$ above.

Alkylene groups represented by L include alkylene groups having 1 to 3 carbon atoms, such as a methylene group and an ethylene group. Arylene groups include a phenylene group.

Typical examples of the hardeners relating to the present invention represented by formulas H-I and H-II above are described in detail below.

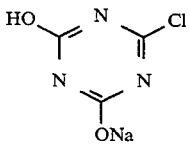
(H-I-1)

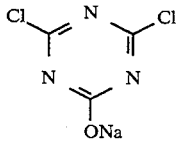
(H-I-2)

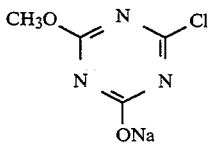
(H-I-3)

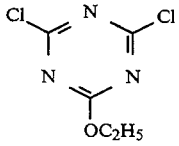
(H-I-4)

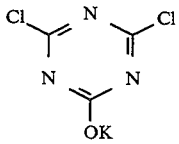
(H-I-5)

-continued

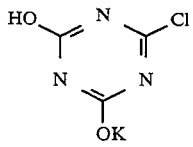
(H-I-6)

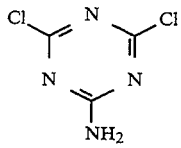
(H-I-7)

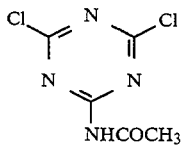
(H-I-8)

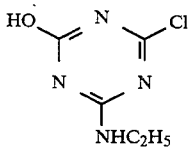
(H-I-9)

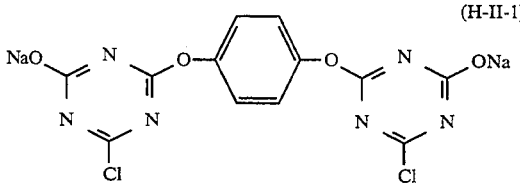
(H-II-1)

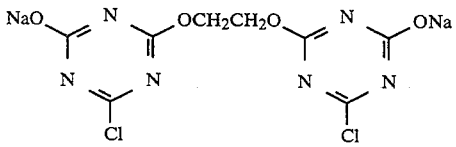
(H-II-2)

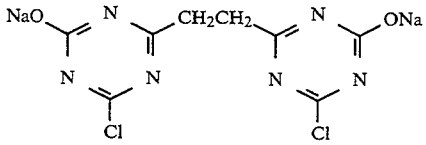
(H-II-3)

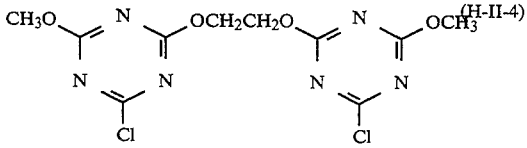
(H-II-4)

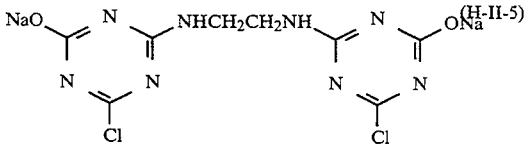
(H-II-5)

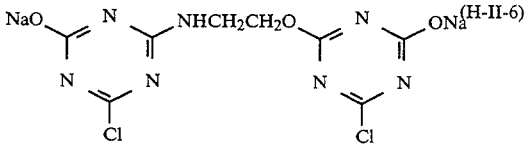
(H-II-6)

-continued

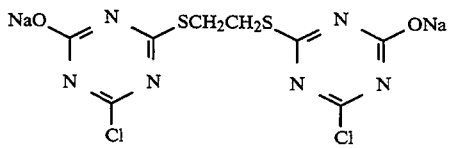
(H-II-7)

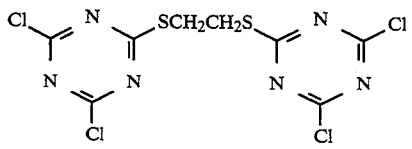
(H-II-8)

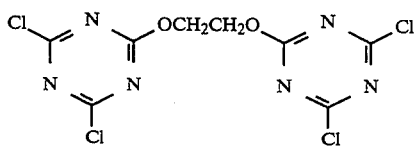
(H-II-9)

For adding the above-mentioned vinyl sulfone hardener relating to the present invention and the hardeners represented by formulas H-I and H-II to silver halide emulsion layers and other photographic structural layers, they are dissolved in water or a water-miscible solvent such as methanol or ethanol, and the resulting solution is added to the coating solution for the structural layers. This addition may be achieved by any of the batch method and the in-line method. Although addition time is not subject to limitation, it is preferable to add the hardener immediately before coating.

With respect to the above-mentioned vinyl sulfone hardener and the hardeners represented by formulas H-I and H-II, it is preferable to use a vinyl sulfone hardener and hardener represented by formula H-I or a vinyl sulfone hardener and H-II in combination. Although the layers to which these hardeners are added may be the same or different, it is preferable to add them to separate layers.

These hardeners are added at 0.5 to 100 mg, preferably 5.0 to 50 mg per gram of coated gelatin.

These hardeners and the amounts of their addition are selected so that the surface pH of the light-sensitive material reaches the level specified by the present invention when they are kept standing at temperatures of 30° to 55° C. and humidities of 30 to 80% RH for 15 to 180 hours after coating and drying.

The silver halide grains of the silver halide photographic light-sensitive material relating to the present invention preferably have a silver chloride content of not less than 90 mol %, a silver bromide content of not more than 10 mol % and a silver iodide content of not more than 0.5 mol %, with more preference given to a silver chlorobromide having a silver bromide content of 0.1 to 2 mol %.

The silver halide grains of the present invention may be used singly or in combination with other kinds of silver halide grains with different composition, and may also be used in combination with silver halide grains having a silver chloride content of not more than 10 mol %.

In the silver halide emulsion layers containing silver halide grains having a silver chloride content of not less than 90 mol %, the silver halide grains having a silver chloride content of not less than 90 mol % account for not less than 60% by weight, preferably not less than 80% by weight of the total silver halide grain content of said emulsion layers.

The composition of the silver halide grains may be uniform from inside to outside, or may be different between inside and outside. In cases where there is a difference in composition between inside and outside, the composition may be changed continuously or discontinuously.

Although the grain size of silver halide grains is not subject to limitation, it is preferable in view of other photographic performance requirements such as rapid processing and sensitivity that the grain size be within the range of 0.2 to 1.6 μm, more preferably from 0.25 to 1.2 μm. The grain size can be determined by various methods in common use in the relevant field. Typical methods are described in "Particle-Size Measurement", ASTM Symposium on Light Microscopy, R. P. Loveland, pp. 94–122 (1955), or Chapter 2 of "The Theory of the Photographic Process", edited by Meath and James, 3rd edition, MacMillan (1966).

The grain size can be determined on the basis of either the projected area of the grain or an approximated diameter. When the grains have a substantially uniform shape, grain size distribution can be expressed with fair accuracy using the diameter or projected area.

The grain size distribution of silver halide grains may be polydispersed or monodispersed. Preferred silver halide grains are monodispersed silver halide grains having a coefficient of variance of silver halide grain distribution of not more than 0.22, more preferably not more than 0.15. Here, the coefficient of variance is a coefficient indicating grain size distribution, as defined by the following equation:

$$\text{Coefficient of variance } (\bar{\sigma}/r) = \frac{\text{standard deviation of grain size distribution}}{\text{average grain size}}$$

$$\text{Standard deviation of grain size distribution } (\sigma) = \sqrt{\frac{\Sigma(\bar{r} - ri)^2 ni}{\Sigma ni}}$$

$$\text{Average grain size } (\bar{r}) = \frac{\Sigma niri}{\Sigma ni}$$

Here, ri represents the diameter of each grain; ni represents the number of grains. Grain size means the diameter of a grain, when the grain is a spherical silver halide grain, or the diameter of the circle with the same area converted from the projected area, when the grain is a cubic or otherwise non-spherical grain.

The silver halide grains used for the present invention may be prepared by any of the acidic method, the neutral method and the ammoniacal method. These grains may be grown at once or grown after seed grain formation. The method of preparing the seed grains and the method of growing them may be identical or different.

As for the mode of reaction of a soluble silver salt and a soluble halide, any of the normal precipitation method, the reverse precipitation method, the double jet precipitation method and combinations thereof may be used, but the grains obtained by the double jet precipitation method are preferred. As a mode of the double jet precipitation method, the pAg controlled double jet method, which is described in Japanese Patent O.P.I. Publication No. 48521/1979, can also be used. If necessary, a silver halide solvent such as thioether may be used. Also, a compound containing a mercapto group, a nitrogen-containing heterocyclic compound or a compound such like a sensitizing dye may be added at the time of silver halide grain formation or after completion of said grains. The silver halide grains for the present invention can be of any shape. A preferred shape is a cube having {100} planes to form the crystal surface. It is also possible to use octahedral, tetradecahedral, dodecahedral or other forms of grains prepared by the methods described in U.S. Pat. Nos. 4,183,756 and 4,225,666, Japanese Patent O.P.I. Publication No. 26589/1980, Japanese Patent Examined Publication No. 42737/1980 and the Journal of Photographic Science, 21, 39 (1973). Grains having twin crystal planes may also be used. The silver halide grains for the present invention may be of a single shape or a combination of various shapes.

To the silver halide grains used for the present invention, a metal ion may be added using a cachnium salt, a zinc salt, a lead salt, a thallium salt, an iridium salt or a complex salt thereof, a rhodium salt or a complex salt thereof or an iron salt or a complex salt thereof to contain such metal elements in and/or on the grains during formation and/or growth of silver halide grains. Also, reduction sensitization specks can be provided in and/or on the grains by bringing the grains in an appropriate reducing atmosphere.

The emulsion to be used in a light-sensitive material of the invention may be optically sensitized by a sensitizing dye. Especially useful dyes are cyanine dyes, merocyanine dyes and complex merocyanine dyes.

These dyes can have any nucleus which is generally used for cyanine dyes as a basic heterocyclic nucleus. Examples of such nuclei include pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus and nuclei resulting from condensation of these nuclei with an alicyclic hydrocarbon ring, nuclei resulting from condensation of these nuclei with an aromatic hydrocarbon ring such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may be substituted on a carbon atom.

The merocyanine dye or complex merocyanine dye may have a 5- or 6--membered heterocyclic nucleus such as a pyrazolin--5-one nucleus, a thiohydantoin nucleus, a 2-thioxazolidine-2,4-dione nucleus, a thiazolidine-2,4-dione nucleus, a rhodanine nucleus or a thiobarbituric acid nucleus as a nucleus having a ketomethylene structure.

For adding sensitizing dyes, methods obvious in the field of photographic material can be used.

For example, these sensitizing dyes may be used in the form of solution in a water-soluble solvent such as pyridine, methyl alcohol, ethyl alcohol, methyl cellosolve, acetone or mixture thereof or in dilution or solution in water. Ultrasonic vibration can also be used during dissolution. The sensitizing dyes for the present invention can be added to emulsion by the method described in U.S. Pat. No. 3,469,987 and other publications, in which a dye is dissolved in a volatile organic solvent, the resulting solution is dispersed in hydrophilic colloid and the resulting dispersion is added to the emulsion, and by the method described in Japanese Patent Examined Publication No. 24185/1971 and other publications, in which a water-insoluble dye is not dissolved but milled in a solid form and dispersed in an aqueous solvent and the resulting dispersion is added to the emulsion. The sensitizing dyes for the present invention can also be added to emulsion in the form of dispersion as prepared by the acid dissolution dispersion method. Other methods which can be used to add sensitizing dyes to emulsion include those described in U.S. Pat. Nos. 2,912,345, 3,342,605, 2,996,287 and 3,425,835.

The sensitizing dyes to be contained in the silver halide emulsion of the present invention may be dissolved in the same or different solvents and added after being mixed before addition to silver halide emulsion or may be added separately. For separate addition, the order, timing and interval can be optionally determined according to the purpose. The sensitizing dyes for the present invention may be added to emulsion at any time during the emulsion production process, but it is preferable to add them during or after chemical ripening, more preferably during chemical ripening.

Examples of supersensitizing dyes which exhibit no spectral sensitizing action or which absorb substantially no visible light include aromatic organic acid formaldehyde condensates such as those described in U.S. Pat. No. 3,437,510, cadmium salts, azaindene compounds, and aminostylbene compounds substituted by nitrogen-containing heterocyclic group such as those described in U.S. Pat. Nos. 2,933,390 and 3,635,721, The combinations described in U.S. Pat. Nos. 3,615,613, 3,615,641, 3,617,295 and 3,635,721 are particularly useful.

Although it is advantageous to use gelatin as a binder or protective colloid for the silver halide emulsion for the present invention, it is possible to use gelatin derivatives, graft polymers of gelatin and other polymer and other hydrophilic colloids such as proteins, sugar derivatives, cellulose derivatives and synthetic hydrophilic polymer substances in the form of homo- or copolymer.

In addition to limed gelatin, acid-treated gelatin and enzymatically treated gelatins such as those described in the Bulletin of the Society of Science of Photography of Japan, No. 16, p. 30 (1966) may be used. Gelatin hydrolyzates and enzyme lysates can also be used.

Examples of gelatin derivatives which can be used include those prepared by reacting gelatin with various compounds such as acid halides, acid anhydrides, isocyanates, bromoacetic acid, alkane suitones, vinyl sulfonamides, maleinimides, polyalkylene oxides and epoxy compounds. Specific examples are given in U.S. Pat. Nos. 2,614,928, 3,132,945, 3,186,846 and 3,312,553, British Patent Nos. 861,414, 1,033,189 and 1,005,784 and Japanese Patent Examined Publication No. 26845/1967.

Preferable proteins are albumin and casein; preferable cellulose derivatives are hydroxyethyl cellulose, carboxymethyl cellulose and cellulose sulfate; preferable sugar derivatives are sodium alginate and starch derivatives.

As graft polymers of gelatin and other polymers, there can be used those prepared by grafting gelatin with a homopolymer or copolymer of a vinyl monomer such as acrylic acid, methacrylic acid, ester or amide derivative thereof, acrylonitrile or styrene. Particularly preferable are graft polymers of gelatin with a polymer which is somewhat compatible with gelatin, such as acrylic acid, acrylamide, methacrylamide or hydroxyalkyl methacrylate. Examples thereof are given in U.S. Pat. Nos. 2,763,625, 2,831,767 and 2,956,884.

Typical synthetic hydrophilic polymer substances include homopolymers and copolymers of polyvinyl alcohol, partially acetalized polyvinyl alcohol, poly-N--

-vinylpyrrolidone, polyacrylic acid, polymethacrylic acid, polyacrylamide, polyvinyl imidazole and polyvinyl pyrazole, specifically those described in West German OLS Patent Application No. 2,312,708, U.S. Pat. Nos. 3,620,751 and 3,879,205 and Japanese Patent Examined Publication No. 7561/1968.

The silver halide photographic light-sensitive material of the present invention may incorporate various photographic additives in addition to the above-mentioned compounds.

Examples of such photographic additives include ultraviolet absorbents such as benzophenone compounds and benzotriazole compounds, development accelerators such as 1-aryl-3-pyrazolidone compounds, surfactants such as alkylnaphthalenesulfonates, alkylsuccinate sulfonates, itaconates and polyalkylene oxide compounds, water-soluble anti-irradiation dyes such as azo compounds, styryl compounds, oxonole compounds, anthraquinone compounds and triphenylmethane compounds, agents for improving coating layer property such as glycerol, polyalkylene glycol, polymer latex and solid or liquid paraffin, anti-color-staining agents such as non-diffusible hydroquinone compounds, dye image stabilizers such as hydroquinone derivatives, gallic acid derivatives, phenol compounds, hydroxycoumarone compounds, polyalkylpiperidine compounds and aromatic amine compounds, water-soluble or oil-soluble brightening agents and background toning agents such as oil-soluble coloring dyes.

Of the dye forming couplers, colored couplers, DIR couplers, DIR compounds, image stabilizers, anti-color-fogging agents, ultraviolet absorbents and brightening agents which need not be adsorbed to the surface of silver halide crystals, hydrophobic compounds can be dispersed by various methods such as solid dispersion, latex dispersion and oil-in-water emulsion dispersion. These methods can be selected as appropriate according to the chemical structure etc. of the hydrophobic compound such as the coupler. Oil-in-water emulsion dispersion can be achieved by various methods of dispersing hydrophobic additives such as couplers; they are usually dissolved in a high boiling organic solvent having a boiling point of not less than 150° C. with low boiling and/or water-soluble organic solvent is used in combination as necessary, and the solution is emulsified and dispersed in a hydrophilic binder such as an aqueous solution of gelatin using a dispersing means such as an agitator, a homogenizer, a colloid mill, a flow jet mixer or an ultrasonicator in the presence of a surfactant, after which the dispersion is added to the target hydrophilic colloid layer. An additional process for removing the dispersion or the low boiling organic solvent performed at the same time as dispersion may be added.

The ratio of high boiling organic solvent and low boiling organic solvent is 1:0.1 to 1:50, preferably 1:1 to 1:20.

Organic solvents having a boiling point of not less than 150° C. are preferably used as high boiling oils, including phenol derivatives, alkyl phthalates, phosphates, citrates, benzoates, alkylamides, fatty acid esters and trimesates.

High boiling organic solvents which can be used for the present invention are specified in U.S. Pat. Nos. 2,322,027, 2,533,514, 2,835,579, 3,287,134, 2,353,262, 2,852,383, 3,554,755, 3,676,137, 3,676,142, 3,700,454, 3,748,141, 3,779,765 and 3,837,863, British Patent Nos. 958,411 and 1,222,753, OLS 2,538,889, Japanese Patent O.P.I. Publication Nos. 1031/1072, 90523/1974, 23823/1975, 26037/1976, 27921/1976, 27922/1976, 26035/1976, 26036/1976, 62632/1975, 1520/1978, 1521/1978, 15127/1978, 119921/1979, 119922/1979, 25057/1980, 36869/1980, 19049/1981 and 81836/1981 and Japanese Patent Examined Publication No. 29060/1973.

Low boiling or water-soluble organic solvents which can be used in combination or in place of high boiling organic solvents include those described in US Patent Nos. 2,801,171 and 2,949,360. Examples of low boiling substantially water-insoluble organic solvents include ethyl acetate, propyl acetate, butyl acetate, butanol, chloroform, carbon tetrachloride, nitromethane, nitroethane and benzene. Water-soluble organic solvents include acetone, methyl isobutyl ketone, β-ethoxyethyl acetate, methoxyglycol acetate, methanol, ethanol, acetonitrile, dioxane, dimethylformamide, dimethylsulfoxide, hexamethylphosphoramide, diethylene glycol monophenyl ether and phenoxyethanol.

Surfactants can be used as dispersion aides. It is preferable to use anionic surfactants such as alkylbenezenesulfonate, alkylnaphthalenesulfonate, alkylsulfonate, alkylsulfate, alkylphosphate, sulfosuccinate and sulfoalkylpolyoxyethylenealkylphenyl ether, nonionic surfactants such as steroid saponin, alkylene oxide derivatives and glycidol derivatives, amphoteric surfactants such as amino acids, aminoalkylsulfonic acids and alkylbetains, and cationic surfactants such as quaternary ammonium salts.

Specific examples of these surfactants are given in "Surface Active Agent Handbook" (Sangyo Tosho, 1966) and "Research and Technical Data for Emulsifying Agent" (Kagaku Hyoron Sha, 1978).

Preferable latex dispersing methods include the methods described in U.S. Pat. Nos. 4,199,363, 4,214,047, 4,203,716 and 4,247,627 and Japanese Patent O.P.I. Publication Nos. 74538/1974, 59942/1976, 59943/1976 and 32552/1979.

The silver halide photographic light-sensitive material of the present invention can form an image by a color developing process known in the field of the art.

Color developing agents for the color developer can be used for the light-sensitive material of the present invention include those which are commonly used in various color photographic processes, specifically aminophenol derivatives and p-phenylenediamine derivatives. These compounds are normally used in the form of a salt such as hydrochloride or sulfate, since they are more stable than the free state. Also, these compounds are used normally at concentrations of about 0.1 to about 30 g, preferably about 1 to about 1.5 g per liter of color developer.

Typical color developing agents for the color developer are aromatic primary amine based compounds, particularly p-phenylenediamine developing agents. Examples of preferable p-phenylenediamine include N,N-diethyl-p-phenylenediamine hydrochloride, N-ethyl-p-phenylenediamine hydrochloride, N,N-dimethyl-p-phenylenediamine hydrochloride, 2-amino-5-(N-ethyl-N-dodecylamino)-toluene, N-ethyl-N-(β-methanesulfonamidoethyl)-3-methyl-4-aminoaniline sulfate, N-ethyl-N-β-hydroxyethylaminoaniline, 4-amino-N-(2-methoxyethyl)-N-ethyl-3-methylaniline-p-toluenesulfonate, N,N-diethyl-3-methyl-4-aminoaniline and N-ethyl-N-(β-hydroxyethyl)-3-methyl-4-aminoaniline.

These color developing agents may be used singly or in combination and one or more kinds thereof may also be used in combination with other black-and-white developing agents such as hydroquinone, 1-phenyl-3-pyrazolidone and N-methyl-p-aminophenol. In this case, a preferable amount of color developing agents added falls in the rage of 0.2 to 2 mol, more preferably of 0.4 to 0.7 mol per mol of the silver halide contained in the silver halide photographic light-sensitive material.

For color developing the silver halide photographic light-sensitive material of the present invention, it is preferable to use as the color developing agent N-ethyl-N-(β-methanesulfonamidoethyl)-3-methyl-4-aminoaniline sulfate out of the above-mentioned compounds.

In addition to the above-mentioned color developing agents, the color developer may incorporate as necessary various photographic additives known in the photographic field, including alkali agents such as sodium hydroxide, potassium hydroxide, sodium carbonate, sodium tertiary phosphate, potassium carbonate, potassium hydrogen carbonate, preservatives such as N,N-diethylhydroxylamine, N,N-bis(methoxyethyl)hydroxylamine, triethanolamine, diethanolamine glucose and potassium sulfite, organic solvents such as methanol, ethanol, butanol, ethylene glycol and diethylene glycol, developing regulators such as citrazinic acid and polyethylene glycol, heavy metal ion sequestering agents and developing accelerators.

When the color developer contains the color developability improving agent, benzyl alcohol, the addition of sulfite ions such as of sodium sulfite and potassium sulfite as preservatives for the color developer causes little reduction in color developability even in relatively large amounts (e.g., not less than about 0.01 mol per liter of color developer). When the benzyl alcohol content in the color developer is 0 to about 5 ml per liter of color developer, it is preferable to keep the sulfite ion concentration below about 0.004 mol per mol of color developer.

The silver halide photographic light-sensitive material of the present invention is preferably developed with a color developer free of water-soluble bromides or containing a very small amount of water-soluble bromides. The bromide ion concentration in the color developer is preferably under about 0.1 g, more preferably under 0.05 g per liter of color developer as of potassium bromide.

If a trace amount of bromide ions elute from the light-sensitive material as a result of development in continuous processing of the light-sensitive material while continuously supplying a color developer replenisher, a trace amount of bromide ions accumulate during color development. Even in this case, it is preferable to keep the bromide ion content in the color developer in the above range by appropriately selecting a replenishing rate of the color developer replenisher relative to the total bromide content in the light-sensitive material.

When the color developer contains a water-soluble chloride as a development regulator, the effect of the present invention is enhanced.

The water-soluble chloride can be used in the content range of 0.5 to 5 g, preferably of 1 to 3 g per liter of color developer as of potassium chloride.

The color developer may also incorporate the organic developing retarder described in Japanese Patent O.P.I. Publication No. 95345/1983, as long as it does not spoil the effect of the present invention. Preferably, adenine and guanine are used in the range of 0 to 0.02 g per liter of color developer.

The pH of the developer is preferably not less than 9.5, more preferably not less than 13. Although it is known that development is accelerated by increasing the pH of the developer, used for the silver halide photographic light-sensitive material of the present invention, sufficient rapid developability is obtained even when the pH is under 11.

Color developer temperature can be 15° to 45° C., preferably 20° to 40° C.

The silver halide photographic light-sensitive material of the present invention is subjected to bleaching and fixation after color development. Bleaching may be conducted at the same time as fixing. Many compounds can be used as bleaching agents, with preference given to polyvalent metal compounds such as iron (III), cobalt (III) and copper (II), particularly complex salts of these polyvalent metal cations and organic acid, such as metal complex salts of aminopolycarboxylic acids such as ethylenediaminetetraacetic acid, nitrilotriacetic acid and N-hydroxyethylethylenediamine diacetic acid, malonic acid, tartaric acid, malic acid, diglycolic acid and dithioglycolic acid, ferricyanate, bichromates, which can be used singly or in combination.

As fixing agents, soluble chelating agents which solubilize silver halide as a complex salt are used. Examples of such soluble chelating agents include sodium thiosulfate, anunonium thiosulfate, potassium thiocyanate, thiourea and thioether.

Fixation is usually followed by washing. Washing may be replaced with stabilization, or both may be conducted. The stabilizer for the stabilization may contain a pH regulator, a chelating agent, a fungicide and other additives. Specific conditions for these procedures are described in Japanese Patent O.P.I. Publication No. 134636/1983 and other publications.

EXAMPLES

Example 1

Layers with the compositions shown below were coated on a paper support, laminated with polyethylene on one face and titanium-oxide-containing polyethylene on the other face, to obtain a multiple-layered photographic light-sensitive material. The coating solutions were prepared as follows. First layer coating solution 26.7 g of a yellow coupler, see table below, 10.0 g of a dye image stabilizer ST-1 and 6.67 g of another dye image stabilizer ST-2 were dissolved in 60 ml of ethyl acetate. This solution was dispersed in 220 ml of a 10% aqueous solution of gelatin containing 7 ml of 204 surfactant SU-1 using an ultrasonic homogenizer to obtain a yellow coupler dispersion. This dispersion was mixed with a blue-sensitive silver chlorobromide emulsion containing 10 g of silver prepared under the following conditions to obtain a first layer coating solution.

The second through seventh layer coating solutions were prepared in the same manner as with the first layer coating solution.

Hardener H-1 was added to layers 2, 4 and 7 at 40, 50 and 60 mg/m$^2$, respectively. Surfactants SU-2 and SU-3, as coating aids, were added to adjust surface tension. For layers 2, 4, 6 and 7, coating solution pH was adjusted using 0.2 M nitric acid to obtain the surface pH level listed in Table 1.

| Layer | Composition | Amount of addition (g/m²) |
|---|---|---|
| Layer 7: Protective layer | Gelatin | 1.00 |
| | Antistaining agent HQ-2 | 0.002 |
| | Antistaining agent HQ-3 | 0.002 |
| | Antistaining agent HQ-4 | 0.004 |
| | Antistaining agent HQ-5 | 0.02 |
| | DIDP | 0.005 |
| | Compound F-1 | 0.002 |
| Layer 6: Ultraviolet absorbing layer | Gelatin | 0.40 |
| | UV absorbent UV-1 | 0.10 |
| | UV absorbent UV-2 | 0.04 |
| | UV absorbent UV-3 | 0.16 |
| | Antistaining agent HQ-5 | 0.04 |
| | DNP | 0.20 |
| | PVP | 0.03 |
| | Anti-irradiation dye AI-2 | 0.02 |
| | Anti-irradiation dye AI-4 | 0.01 |
| Layer 5: Red-sensitive layer | Gelatin | 1.30 |
| | Red-sensitive silver chlorobromide emulsion Em-R | 0.21 |
| | Cyan coupler (compound A in Table 1) | 0.17 |
| | Cyan coupler C-2 | 0.25 |
| | Dye image stabilizer ST-1 | 0.20 |
| | Antistaining agent HQ-1 | 0.01 |
| | HBS-1 | 0.20 |
| | DOP | 0.20 |
| Layer 4: Ultraviolet absorbing layer | Gelatin | 0.94 |
| | UV absorbent UV-1 | 0.28 |
| | UV absorbent UV-2 | 0.09 |
| | UV absorbent UV-3 | 0.38 |
| | Antistaining agent HQ-5 | 0.10 |
| | DNP | 0.40 |
| Layer 3: Green-sensitive layer | Gelatin | 1.40 |
| | Green-sensitive silver chlorobromide emulsion Em-G | 0.17 |
| | Magenta coupler (compound B in Table 1) | 0.23 |
| | Dye image stabilizer ST-3 | 0.20 |
| | Dye image stabilizer ST-4 | 0.17 |
| | DIDP | 0.13 |
| | DBP | 0.13 |
| | Anti-irradiation dye AI-1 | 0.01 |
| Layer 2: Interlayer | Gelatin | 1.20 |
| | Antistaining agent HQ-2 | 0.03 |
| | Antistaining agent HQ-3 | 0.03 |
| | Antistaining agent HQ-4 | 0.05 |
| | Antistaining agent HQ-5 | 0.23 |
| | DIDP | 0.06 |
| | Compound F-1 | 0.002 |
| Layer 1: Blue-sensitive layer | Gelatin | 1.20 |
| | Blue-sensitive silver chlorobromide emulsion Em-B | 0.26 |
| | Yellow coupler see Table 1) | 0.80 |
| | Dye image stabilizer ST-1 | 0.30 |
| | Dye image stabilizer ST-2 | 0.20 |
| | Antistaining agent HQ-1 | 0.02 |
| | Anti-irradiation dye AI-3 | 0.01 |
| | DNP | 0.20 |
| Support | Polyethylene-laminated paper | |

Amounts of silver halide emulsions are expressed in terms of silver.

Preparation of Blue-Sensitive Silver Chlorobromide Emulsion

To 1000 ml of a 2% aqueous solution of gelatin kept at 40° C., the following solutions A and B were simultaneously added over a period of 30 minutes while maintaining a pAg of 6.5 and a pH of 3.0, after which the following solutions C and D were simultaneously added over a period of 180 minutes while maintaining a pAg of 7.3 and a pH of 5.5. The pAg was regulated by the method described in Japanese Patent O.P.I. Publication No. 45437/1984. The pH was regulated using an aqueous solution of sulfuric acid or sodium hydroxide.

| | |
|---|---|
| Solution A | |
| Sodium chloride | 3.42 g |
| Potassium bromide | 0.03 g |
| Water was added to make a total quantity of 200 ml. | |
| Solution B | |
| Silver Nitrate | 10 g |
| Water was added to make a total quantity of 200 ml. | |
| Solution C | |
| Sodium chloride | 102.7 g |
| Potassium bromide | 1.0 g |
| Water was added to make a total quantity of 600 ml. | |
| Solution D | |
| Silver nitrate | 300 g |

Water was added to make a total quantity of 600 ml.

After completion of the addition, the mixture was desalinized using a 5% aqueous solution of Demol N, a product of Kao Atlas, and a 20% aqueous solution of magnesium sulfate and then mixed with an aqueous solution of gelatin to obtain a monodispersed emulsion EMP-1 comprising cubic grains having an average grain size of 0.85 μm, a coefficient of variance ($\sigma/r$) of 0.07 and a silver chloride content of 99.5 mol %.

The resulting emulsion EMP-1 was chemically ripened with the following compounds at 50° C. for 90 minutes to obtain a blue-sensitive silver chlorobromide emulsion, Em-B.

| | |
|---|---|
| Sodium thiosulfate | 0.8 mg/mol AgX |
| Chloroauric acid | 0.5 mg/mol AgX |
| Stabilizer STB-1 | $6 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of Green-Sensitive Silver Chlorobromide Emulsion

A monodispersed emulsion EMP-2 comprising cubic grains having an average grain size of 0.43 μm, a coefficient of variance ($\sigma/r$) of 0.08 and a silver chloride content of 99.5 mol % was prepared in the same manner as EMP-1 except that the addition time for solutions A and B and the addition time for solutions C and D were changed.

The resulting emulsion, EMP-2, was chemically ripened with the following compounds at 55° C. for 120 minutes to obtain a green-sensitive silver chlorobromide emulsion, Em-G.

| | |
|---|---|
| Sodium thiosulfate | 1.5 mg/mol AgX |
| Chloroauric acid | 1.0 mg/mol AgX |
| Stabilizer STB-1 | $6 \times 10^{-4}$ mol/mol AgX |
| Sensitizing dye GS-1 | $4 \times 10^{-4}$ mol/mol AgX |

Preparation of Red-Sensitive Silver Halide Chlorobromide

A monodispersed emulsion, EMP-3, comprising cubic grains having an average grain size of 0.50 μm, a coefficient of variance ($\sigma/r$) of 0.08 and a silver chloride content of 99.5 mol % was prepared in the same manner as EMP-1 except that the addition time for solutions A and B and the addition time for solutions C and D were changed.

The resulting emulsion, EMP-3, was chemically ripened with the following compounds at 60° C. for 90 minutes to obtain a red-sensitive silver chlorobromide emulsion Em-R.

| | |
|---|---|
| Sodium thiosulfate | 1.8 mg/mol AgX |
| Chloroauric acid | 2.0 mg/mol AgX |
| Stabilizer STB-1 | $6 \times 10^{-4}$ mol/mol AgX |
| Sensitizing dye RS-1 | $1 \times 10^{-4}$ mol/mol AgX |

C-2

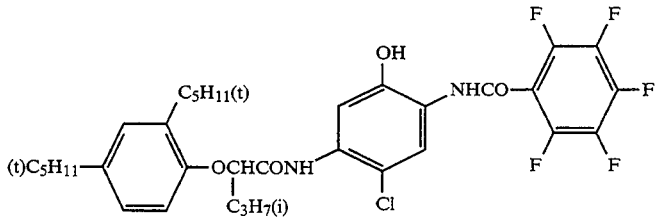

ST-1

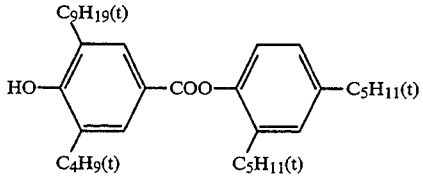

ST-2

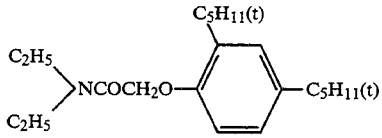

ST-3

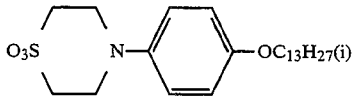

ST-4

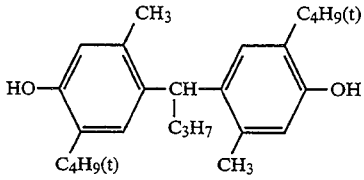

UV-1

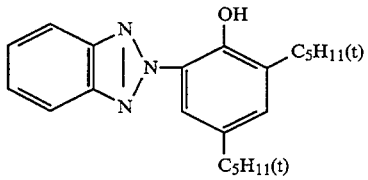

UV-2

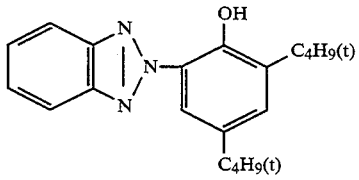

UV-3

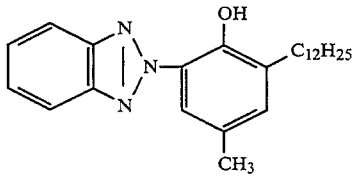

DBP: dibutyl phthalate
DOP: dioctyl phthalate
DNP: dinonyl phthalate
DIDP: diisodecyl phthalate -continued
HQ-1
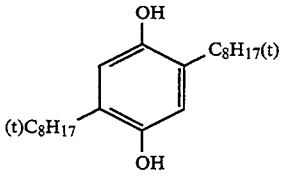
HQ-2
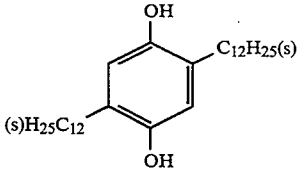
HQ-3
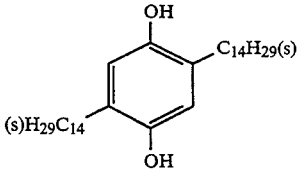
HQ-4
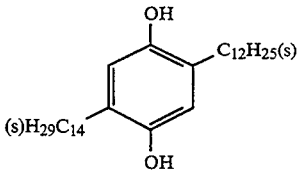
HQ-5
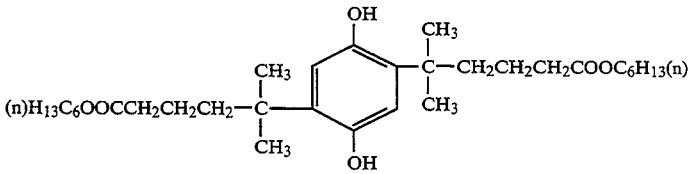
HBS-1
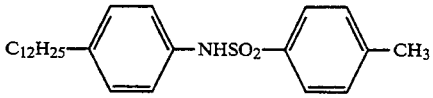
AI-1
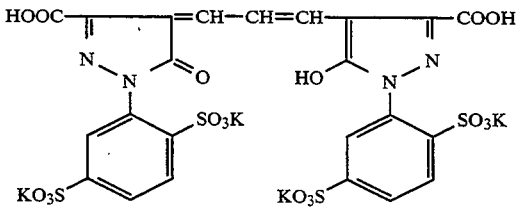
AI-2
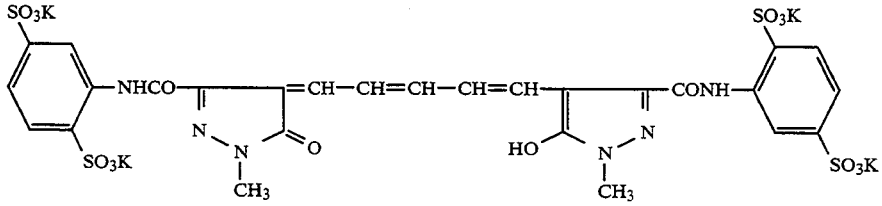
AI-3
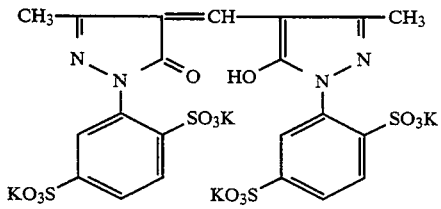

-continued
AI-4
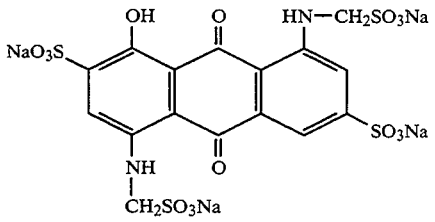
SU-1
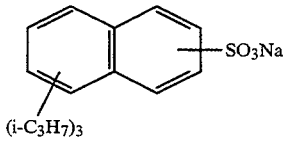
SU-2
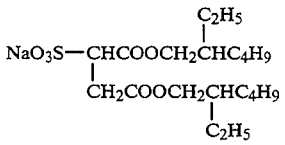
SU-3
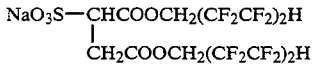
H-1
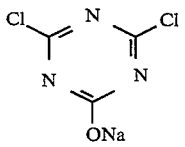
F-1
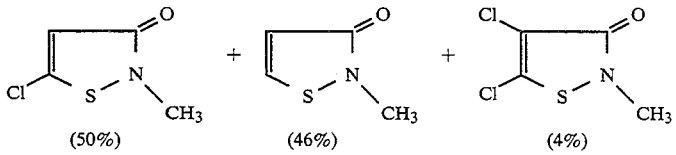
molecular ratio
BS-1
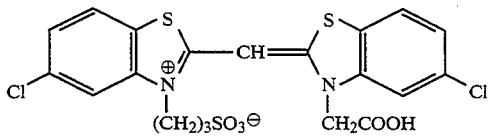
BS-2
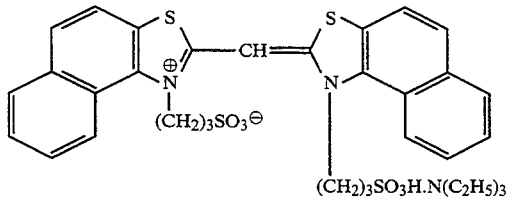
GS-1
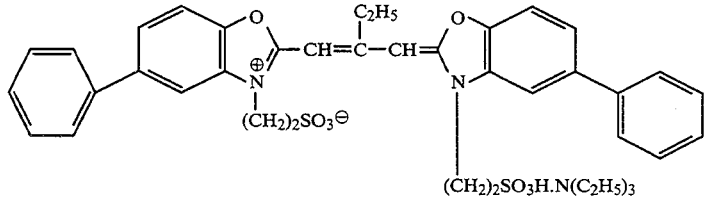

-continued

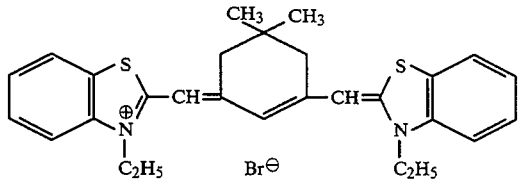

RS-1

Evaluation of Storage Stability

The samples prepared above were stored at 40° C. and 40% RH for 3 weeks, after which they were subjected to exposure through an optical wedge and processed in the processes described below. The samples thus processed were subjected to densitometry for yellow and magenta dye images using a PDA-65 densitometer, and the sensitivity, the reciprocal of the amount of exposure giving a density of 1.0, and the minimum density $D_{min}$ were determined. Table 1 compares the stored samples and fresh ones with regard to sensitivity and $D_{min}$ change.

$$*1: \Delta S = \frac{\text{(sensitivity after storage)}}{\text{(sensitivity before storage)}} \times 100 - 100$$

$$*2: \Delta D_{min} = (D_{min} \text{ after storage}) - (D_{min} \text{ before storage})$$

Processing Procedure

| | Temperature (°C.) | Time (sec) | Replenishing rate (ml/m²) |
|---|---|---|---|
| Color development | 38.0 ± 0.3 | 45 | 120 |
| Bleach-fixation | 35.0 ± 0.5 | 45 | 54 |
| Stabilization | 30 to 40 | 90 | 250 |
| Drying | 50 to 75 | 60 | |

| Color developer | Tank solution | Replenisher |
|---|---|---|
| Potassium bromide | 20 mg | 8.0 mg |
| Potassium chloride | 2.0 g | — |
| Potassium sulfite (50% aqueous solution) | 0.6 ml | 1.0 ml |
| N-ethyl-N-(β-methanesulfonamidoethyl)-3-methyl-4-aminoaniline sulfate | 4.5 g | 9.2 g |
| N,N-diethylhydroxylamine | 5.0 g | 9.0 g |
| Triethanolamine | 10.0 g | 15.0 g |
| Potassium carbonate | 27.0 g | 30.0 g |
| Sodium ethylenediaminetetraacetate | 1.0 g | 2.0 g |
| Brightening agent (diaminostylbenedisulfonic acid derivative) | 1.0 g | 2.2 g |

Water was added to make a total quantity of 1 l, and sodium hydroxide or sulfuric acid was added to obtain a pH of 10.10 for the tank solution and a pH of 10.60 for the replenisher.

Bleach-Fixer, Common to the Tank Solution and the Replenisher

| | |
|---|---|
| Ammonium ferric ethylenediaminetetraacetate dihydrate | 20 g |
| Ethylenediaminetetraacetic acid | 3 g |
| Ammonium thiosulfate (70% aqueous solution) | 200 ml |
| Ammonium sulfite (40% aqueous solution) | 85 ml |

Water was added to make a total quantity of 1 l, and aqueous ammonia or glacial acetic acid was added to obtain a pH of 5.0.

Stabilizer, Common to the Tank Solution and the Replenisher

| | |
|---|---|
| 5-chloro-2-methyl-4-isothiazolin-3-one | 0.02 g |
| 2-methyl-4-isothiazolin-3-one | 0.02 g |
| Ethylene glycol | 1.0 g |
| 2-octyl-4-isothiazolin-3-one | 0.01 g |
| 1-hydroxyethylidene-1,1-disulfonic acid (60% aqueous solution) | 3.0 g |
| 45% aqueous solution of $BiCl_3$ | 0.65 g |
| 25% aqueous solution of $MgSO_4.7H_2O$ | 0.20 g |
| 25% aqueous solution of ammonium hydroxide | 2.5 g |
| Trisodium nitrilotriacetate | 1.5 g |

Water was added to make a total quantity of 1 l, and aqueous ammonia or sulfuric acid was added to obtain a pH of 7.0.

Evaluation of Stability to pH Fluctuation of Color Developer

The sample was subjected to exposure through an optical wedge, after which it was developed with the color developers adjusted to pH levels of 9.7 and 10.5 with sulfuric acid or sodium hydroxide in the previous process. Bleach-fixation and following processes were the same as the processes described above. The developed sample was subjected to densitometry for yellow and magenta reflected densities using a PDA-65 densitometer, and a characteristic curve was drawn. For each sample, gradation γ (gradation for reflective densities of 0.2 to 0.7) was determined. Table 3 shows data on the size of gradation fluctuation (Δγ).

Δγ=(γ of the sample processed with a color developer of pH 10.5)−(γ of the sample processed with a color developer of pH (9.7)

TABLE 1

| Sample | Yellow coupler | Magenta coupler | Surface pH | Storage stability ΔS (%) Yellow | Storage stability ΔS (%) Magenta | Storage stability $\Delta D_{min}$ Yellow | Storage stability $\Delta D_{min}$ Magenta | Stability to pH fluctuation of color developer Yellow | Stability to pH fluctuation of color developer Magenta | Remark |
|---|---|---|---|---|---|---|---|---|---|---|
| 1 | Y-3 | M-2 | 5.10 | +25 | +28 | +0.19 | +0.20 | −0.21 | −0.28 | Comparative |
| 2 | Y-3 | M-2 | 5.30 | +24 | +26 | +0.20 | +0.18 | −0.23 | −0.28 | Comparative |
| 3 | Y-3 | M-2 | 5.45 | +14 | +16 | +0.13 | +0.14 | −0.13 | −0.16 | Inventive |

TABLE 1-continued

| Sample | Yellow coupler | Magenta coupler | Surface pH | Storage stability ΔS (%) Yellow | Storage stability ΔS (%) Magenta | Storage stability $\Delta D_{min}$ Yellow | Storage stability $\Delta D_{min}$ Magenta | Stability to pH fluctuation of color developer Yellow | Stability to pH fluctuation of color developer Magenta | Remark |
|---|---|---|---|---|---|---|---|---|---|---|
| 4 | Y-3 | M-2 | 5.85 | +13 | +14 | +0.13 | +0.15 | −0.15 | −0.15 | Inventive |
| 5 | Y-3 | M-2 | 6.00 | +21 | +25 | +0.31 | +0.36 | −0.28 | −0.31 | Comparative |
| 6 | Compound A | M-2 | 5.45 | +23 | +25 | +0.32 | +0.37 | −0.24 | −0.25 | Comparative |
| 7 | Compound A | Compound B | 5.45 | +27 | +27 | +0.41 | +0.38 | −0.25 | −0.27 | Comparative |
| 8 | Y-3 | Compound B | 5.45 | +26 | +27 | +0.16 | +0.16 | −0.15 | −0.17 | Inventive |
| 9 | Y-3 | Compound B | 5.10 | +29 | +28 | +0.19 | +0.18 | −0.25 | −0.29 | Comparative |
| 10 | Y-3 | Compound B | 5.97 | +27 | +25 | +0.34 | +0.38 | −0.22 | −0.26 | Comparative |
| 11 | Y-2 | Compound B | 5.30 | +24 | +25 | +0.21 | +0.29 | −0.27 | −0.28 | Comparative |
| 12 | Y-2 | Compound B | 5.50 | +15 | +17 | +0.12 | +0.13 | −0.16 | −0.13 | Inventive |
| 13 | Y-55 | Compound B | 5.31 | +23 | +29 | +0.19 | +0.21 | −0.25 | −0.30 | Comparative |
| 14 | Y-55 | Compound B | 5.63 | +15 | +17 | +0.16 | +0.17 | −0.14 | −0.13 | Inventive |
| 15 | Y-55 | Compound B | 5.97 | +28 | +24 | +0.28 | +0.40 | −0.29 | −0.26 | Comparative |
| 16 | Compound A | M-3 | 5.31 | +24 | +29 | +0.21 | +0.20 | −0.26 | −0.31 | Comparative |
| 17 | Compound A | M-3 | 5.97 | +27 | +26 | +0.29 | +0.30 | −0.31 | −0.23 | Comparative |
| 18 | Compound A | M-5 | 5.30 | +22 | +25 | +0.18 | +0.20 | −0.28 | −0.27 | Comparative |
| 19 | Compound A | M-5 | 5.60 | +24 | +27 | +0.33 | +0.38 | −0.25 | −0.26 | Comparative |
| 20 | Y-6 | M-4 | 5.58 | +11 | +14 | +0.14 | +0.13 | −0.11 | −0.11 | Inventive |
| 21 | Y-20 | M-6 | 5.74 | +10 | +14 | +0.15 | +0.16 | −0.11 | −0.13 | Inventive |

Compound A

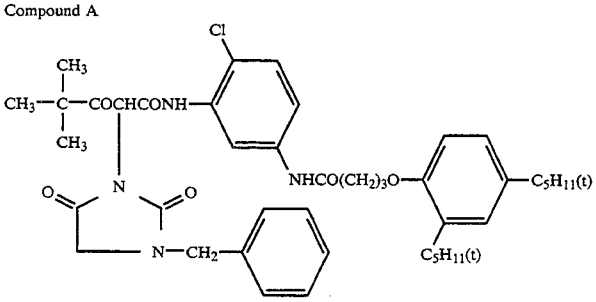

Compound B

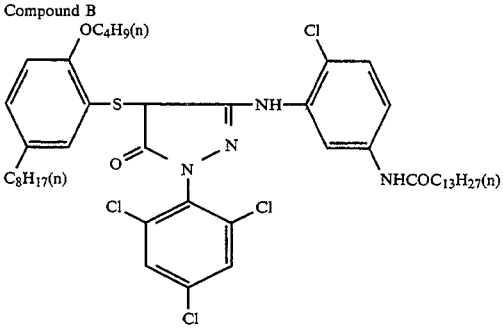

As shown in Table 1, samples according to the present invention (sample Nos. 3, 4, 8, 12, 14, 20, 21), whose surface pH has been adjusted to between 5.4 and 5.9 and which contain at least one kind of the compound represented by formula I are excellent in storage stability and remain stable as to gradation even when color developer pH changes. It is also evident that when the surface pH of a sample was adjusted to under 5.4, the storage stability is unsatisfactory, though the increase in minimum density improves to some extent.

Example 2

Samples were prepared in the same manner as in Example 1 except that sensitizers listed in Table 2 and elemental sulfur were added to the blue-, green- and red-sensitive silver chlorobromide emulsions at the time of starting chemical sensitization thereof. Sulfur sensitizers and gold sensitizers were used in the same amounts as in Example 1. The yellow coupler used was Y-2 of Example 1, and the magenta coupler used was M-2 of Example 1.

TABLE 2

| Sample No. | Sulfur sensitizer | Gold sensitizer | Amount of elemental sulfur added (μg/mol) | Surface pH | Storage stability ΔS (%) Yellow | Storage stability ΔS (%) Magenta | Storage stability $\Delta D_{min}$ Yellow | Storage stability $\Delta D_{min}$ Magenta | Stability to pH fluctuation of color developer Yellow | Stability to pH fluctuation of color developer Magenta | Remark |
|---|---|---|---|---|---|---|---|---|---|---|---|
| 1 | Sodium thiosulfate | Chloroauric acid | 0 | 5.10 | +25 | +28 | +0.19 | +0.20 | −0.21 | −0.28 | Comparative |
| 2 | Sodium thiosulfate | Chloroauric acid | 0 | 5.45 | +14 | +16 | +0.13 | +0.14 | −0.13 | −0.16 | Inventive |
| 3 | Sodium thiosulfate | Chloroauric acid | 0 | 6.02 | +21 | +25 | +0.31 | +0.36 | −0.28 | −0.31 | Comparative |
| 4 | Sodium | None | 0 | 5.10 | +24 | +25 | +0.18 | +0.21 | −0.25 | −0.34 | Comparative |

TABLE 2-continued

| Sample No. | Sulfur sensitizer | Gold sensitizer | Amount of elemental sulfur added (μg/mol) | Surface pH | Storage stability ΔS (%) Yellow | Storage stability ΔS (%) Magenta | Storage stability $\Delta D_{min}$ Yellow | Storage stability $\Delta D_{min}$ Magenta | Stability to pH fluctuation of color developer Yellow | Stability to pH fluctuation of color developer Magenta | Remark |
|---|---|---|---|---|---|---|---|---|---|---|---|
| | thiosulfate | | | | | | | | | | |
| 5 | Sodium thiosulfate | None | 0 | 5.45 | +9 | +8 | +0.14 | +0.15 | −0.15 | −0.13 | Inventive |
| 6 | Sodium thiosulfate | None | 0 | 6.02 | +28 | +44 | +0.27 | +0.30 | −0.25 | −0.27 | Comparative |
| 7 | None | Chloroauric acid | 0 | 5.10 | +30 | +28 | +0.30 | +0.32 | −0.34 | −0.31 | Comparative |
| 8 | None | Chloroauric acid | 0 | 5.45 | +14 | +15 | +0.16 | +0.16 | −0.14 | −0.13 | Inventive |
| 9 | None | Chloroauric acid | 0 | 6.02 | +26 | +27 | +0.29 | +0.28 | −0.30 | −0.31 | Comparative |
| 10 | Dimethylthiourea | Potassium aurate | | 5.66 | +16 | +15 | +0.16 | +0.14 | −0.13 | −0.14 | Inventive |
| 11 | Dimethylthiourea | None | 0 | 5.66 | +5 | +7 | +0.15 | +0.13 | −0.13 | −0.13 | Inventive |
| 12 | None | Potassium aurate | 0 | 5.51 | +17 | +18 | +0.15 | +0.14 | −0.15 | −0.14 | Inventive |
| 13 | Cystine | None | 0 | 5.51 | +6 | +4 | +0.12 | +0.13 | −0.14 | −0.15 | Inventive |
| 14 | Cystine | Ammonium aurothiocyanate | 0 | 5.51 | +15 | +17 | +0.16 | +0.16 | −0.17 | −0.15 | Inventive |
| 15 | Rhodanine | None | 0 | 5.72 | +5 | +4 | +0.13 | +0.15 | −0.16 | −0.15 | Inventive |
| 16 | Sodium thiosulfate | Chloroauric acid | 40 | 5.10 | +26 | +27 | +0.25 | +0.28 | −0.26 | −0.34 | Comparative |
| 17 | Sodium thiosulfate | Chloroauric acid | 40 | 5.45 | +2 | +1 | +0.20 | +0.03 | −0.05 | −0.03 | Inventive |
| 18 | Sodium thiosulfate | Chloroauric acid | 40 | 6.02 | +29 | +31 | +0.21 | +0.26 | −0.28 | −0.30 | Comparative |
| 19 | Sodium thiosulfate | Chloroauric acid | 125 | 5.10 | +26 | +29 | +0.26 | +0.29 | −0.26 | −0.23 | Comparative |
| 20 | Sodium thiosulfate | Chloroauric acid | 125 | 5.45 | +1 | −2 | +0.03 | +0.01 | −0.02 | −0.01 | Inventive |
| 21 | Sodium thiosulfate | Chloroauric acid | 125 | 6.02 | +25 | +26 | +0.31 | +0.29 | −0.28 | −0.23 | Comparative |

As is evident from table 2, samples prepared with silver halide grains which have been chemically sensitized by sulfur sensitization alone (sample Nos. 5, 11, 13, 15) are excellent in storage stability to sensitivity fluctuation.

It is also evident that samples prepared with elemental sulfur (sample Nos. 17, 20) are excellent in storage stability to sensitivity fluctuation, increase in minimum density and color developer pH fluctuation.

Example 3

Samples were prepared in the same manner as in Example 1 except that hardeners listed in Table 3 were used in layers 2, 4, 6 and 7 in the same amounts as in Example 1. The yellow coupler used was Y-2, and the magenta coupler used was M-2.

TABLE 3

| Sample No. | Vinyl sulfone hardener | Target layers | Formula H-I or H-II | Target layers | Surface pH | Storage stability ΔS (%) Yellow | Storage stability ΔS (%) Magenta | Storage stability $\Delta D_{min}$ Yellow | Storage stability $\Delta D_{min}$ Magenta | Stability to pH fluctuation of color developer Yellow | Stability to pH fluctuation of color developer Magenta | Remark |
|---|---|---|---|---|---|---|---|---|---|---|---|---|
| 1 | H-19 | 2, 4, 7 | None | None | 5.15 | +26 | +28 | +0.28 | +0.31 | −0.26 | −0.31 | Comparative |
| 2 | H-19 | 2, 4, 7 | None | None | 5.64 | +15 | +14 | +0.12 | +0.10 | −0.12 | −0.10 | Inventive |
| 3 | H-19 | 2, 4, 7 | None | None | 5.98 | +28 | +31 | +0.25 | +0.28 | −0.29 | −0.35 | Comparative |
| 4 | None | None | H-I-2 | 2, 4, 7 | 5.15 | +24 | +21 | +0.29 | +0.26 | −0.22 | −0.27 | Comparative |
| 5 | None | None | H-I-2 | 2, 4, 7 | 5.64 | +14 | +16 | +0.14 | +0.16 | −0.14 | −0.11 | Inventive |
| 6 | None | None | H-I-2 | 2, 4, 7 | 5.98 | +23 | +26 | +0.25 | +0.27 | −0.27 | −0.29 | Comparative |
| 7 | H-19 | 2, 4 | H-I-2 | 7 | 5.15 | +27 | +21 | +0.23 | +0.26 | −0.25 | −0.32 | Comparative |
| 8 | H-19 | 2, 4 | H-I-2 | 7 | 5.64 | +3 | −1 | +0.13 | +0.15 | −0.08 | −0.05 | Inventive |
| 9 | H-19 | 2, 4 | H-I-2 | 7 | 5.98 | +25 | +23 | +0.31 | +0.30 | −0.31 | −0.35 | Comparative |
| 10 | H-12 | 2, 4 | H-II-2 | 7 | 5.45 | +5 | +3 | +0.13 | +0.10 | −0.04 | −0.03 | Inventive |
| 11 | H-12 | 2 | H-II-2 | 6, 7 | 5.52 | +2 | +3 | +0.16 | +0.13 | −0.06 | −0.07 | Inventive |
| 12 | H-12 | 7 | H-II-2 | 2, 4 | 5.67 | 0 | −2 | +0.15 | +0.14 | −0.02 | −0.06 | Inventive |
| 13 | H-12 | 2, 4, 7 | None | None | 5.72 | +14 | +13 | +0.15 | +0.12 | −0.15 | −0.11 | Inventive |
| 14 | None | None | H-II-2 | 2, 4, 7 | 5.48 | +13 | +15 | +0.11 | +0.17 | −0.16 | −0.13 | Inventive |
| 15 | Compound C | 2, 4, 7 | None | None | 5.15 | +27 | +29 | +0.28 | +0.36 | −0.26 | −0.33 | Comparative |
| 16 | Compound C | 2, 4, 7 | None | None | 5.64 | +16 | +12 | +0.17 | +0.18 | −0.14 | −0.11 | Inventive |

TABLE 3-continued

| Sample No. | Vinyl sulfone hardener | Target layers | Formula H-I or H-II | Target layers | Surface pH | Storage stability ΔS (%) Yellow | Magenta | ΔD$_{min}$ Yellow | Magenta | Stability to pH fluctuation of color developer Yellow | Magenta | Remark |
|---|---|---|---|---|---|---|---|---|---|---|---|---|
| 17 | Compound C | 2, 4 | H-I-2 | 7 | 5.77 | +15 | +14 | +0.16 | +0.14 | −0.12 | −0.15 | Inventive |

Compound C

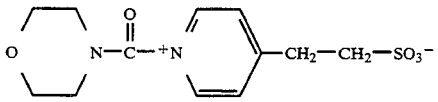

As shown in Table 3, sample prepared with a vinyl sulfone hardener and a hardener represented by formula III or IV (sample Nos. 8, 10, 11, 12) have considerably lowered sensitivity fluctuation in storage and are stable to color developer pH fluctuation.

What is claimed is:

1. A silver halide photographic light-sensitive material comprising a support having thereon photographic layers including a silver halide emulsion layer wherein the outermost surface of said photographic material has a pH value of from 5.4 to 5.9 and said silver halide emulsion layer contains a compound represented by the following formula I;

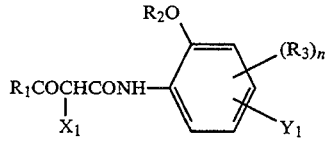

(I)

wherein $R_1$ is an alkyl group, a cycloalkyl group or an aryl group; $R_2$ is an alkyl group, a cycloalkyl group, an acyl group or an aryl group; $R_3$ is a group capable of being a substituent of the benzene ring, n is 0 or 1; $X_1$ is a substituent capable of splitting off upon coupling reaction with the oxidation product of a color developing agent; and $Y_1$ is an organic group.

2. The light-sensitive material of claim 1, wherein said compound represented by formula I is a compound represented by the following formula V;

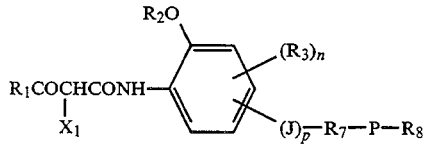

(V)

wherein $R_1$, $R_2$, $R_3$, $X_1$ and n are the same as $R_1$, $R_2$, $R_3$, $X_1$ and n defined in formula I, respectively; J is a —N($R_5$)CO— group or a —CON($R_5$)— grup in which $R_5$ is a hydrogen atom, an alkyl group, an aryl group or a heterocyclic group; p is 0 or 1; $R_7$ is an alkylene group, an arylene group, an alkylenearylene group, an arylenealkylene group or an —A—$V_1$—B— group in which A and B are each an alkylene group, an arylene group, an alkylenearylene group, an arylenealkylene group and $V_1$ is a di-valent bonding group; $R_8$ is an alkyl group, a cycloalkyl group, an aryl group or a heterocyclic group; and P is a bonding group including a carbonyl unit or a sulfonyl unit.

3. The light-sensitive material of claim 1, wherein silver halide grains contained in said silver halide emulsion layer are chemically sensitized only by sulfur sensitization.

4. The light-sensitive material of claim 1, wherein silver halide grains contained in said silver halide emulsion layer are chemically sensitized in the presence of elemental sulfur.

5. The light-sensitive material of claim 1, wherein at least one photographic layer contains a vinylsulfone-type hardener and a compound represented by the following formula H-I or H-II;

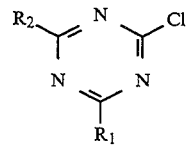

(H-I)

wherein $R_1$ is a chlorine atom, a hydroxy group, an alkyl group, an alkoxy group, an alkylthio group, an —$OM_1$ group in which $M_1$ is a mono-valent metal atom, an —$NR_5R_6$ group in which $R_5$ and $R_6$ are each a hydrogen atom, an alkyl group or an aryl group, or a —$NHCOR_7$ group in which $R_7$ is a hydrogen atom, an alkyl group or an aryl group; and $R_2$ is a group which is the same as that represented by $R_1$ except that $R_2$ cannot comprise a chlorine atom;

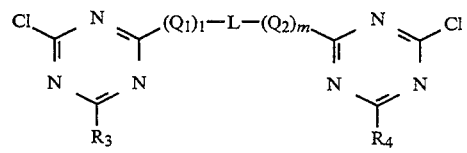

(H-II)

wherein $R_3$ and $R_4$ are each a chlorine atom, a hydroxy group, an alkyl group, an alkoxy group or an —$OM_1$ group in which $M_1$ is a mono-valent metal atom; $Q_1$ and $Q_2$ are each —O—, —S— or —NH—; L is an alkylene group or an arylene group; l and m are each 0 or 1.

6. The light-sensitive material of claim !, wherein said silver halide emulsion layer comprises silver halide grains having a silver chloride content of at least 90 mol %.

* * * * *